US007891751B2

(12) United States Patent
Kuwahara et al.

(10) Patent No.: US 7,891,751 B2
(45) Date of Patent: Feb. 22, 2011

(54) LIQUID EJECTOR AND METHOD FOR EJECTING LIQUID

(75) Inventors: Soichi Kuwahara, Kanagawa (JP); Iwao Ushinohama, Kanagawa (JP); Manabu Tomita, Kanagawa (JP); Yuichiro Ikemoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 7 days.

(21) Appl. No.: 11/958,002

(22) Filed: Dec. 17, 2007

(65) Prior Publication Data

US 2008/0106562 A1 May 8, 2008

Related U.S. Application Data

(62) Division of application No. 10/531,511, filed as application No. PCT/JP03/13316 on Oct. 17, 2003.

(30) Foreign Application Priority Data

Oct. 18, 2002 (JP) ..... P2002-303913
May 29, 2003 (JP) ..... P2003-153320

(51) Int. Cl.
*B41J 29/38* (2006.01)

(52) U.S. Cl. ..... 347/14; 347/19; 347/78; 347/82; 422/62

(58) Field of Classification Search ..... None
See application file for complete search history.

(56) References Cited

U.S. PATENT DOCUMENTS 6,543,874 B2 4/2003 Matsumoto
6,557,961 B2 5/2003 Cheng et al.
2001/0038397 A1 11/2001 Kobayashi et al.
2005/0088469 A1* 4/2005 Igarashi ..... 347/14

FOREIGN PATENT DOCUMENTS

JP 05-238021 9/1993

(Continued)

OTHER PUBLICATIONS

International Search Report dated Dec. 16, 2003 corresponding to PCT/JP/13316.

(Continued)

*Primary Examiner*—Matthew Luu
*Assistant Examiner*—John P Zimmermann
(74) *Attorney, Agent, or Firm*—SNR Denton US LLP

(57) ABSTRACT

A liquid discharge apparatus that is capable of setting a proper deflection amount for deflecting an ink discharge direction even when the distance between the ink discharge surface and the ink landing surface of print paper varies and method of using same. The liquid discharge apparatus includes a head in which a plurality of nozzle-incorporated ink discharge sections are arrayed, discharge direction deflection means for deflecting the discharge direction of an ink discharged from a nozzle of each ink discharge section in the direction of ink discharge section arrangement, distance detection means for detecting the distance between the ink discharge surface of the head and the ink landing surface of print paper, and discharge deflection amount determination means for determining the ink discharge deflection amount (discharge angle) to be provided by the discharge direction deflection means in accordance with the results of detection by the distance detection means.

1 Claim, 15 Drawing Sheets

FOREIGN PATENT DOCUMENTS

| | | |
|---|---|---|
| JP | 07-081065 | 3/1995 |
| JP | 08-197738 | 8/1996 |
| JP | 08-207322 | 8/1996 |
| JP | 08197738 | 8/1996 |
| JP | 11-048468 | 2/1999 |
| JP | 11048468 | 2/1999 |
| JP | 2000-094784 | 4/2000 |
| JP | 2000-127553 | 5/2000 |
| JP | 2000127553 | 5/2000 |
| JP | 2000-185403 | 7/2000 |
| JP | 2002-200753 | 7/2002 |
| JP | 2002-240287 | 8/2002 |

OTHER PUBLICATIONS

JP 07-081065—A Yoshiyama et al. Machine Language Translation http://www4.ipdl/inpit.go.jp/Tokujitu/tjsogodbenk.ipdl Retrieved Sep. 13, 2007.

JP 08-197738 A—Kurihara et al. Machine Language Translation http://www4.ipdl/inpit.go.jp/Tokujitu/tjsogodbenk.ipdl Retrieved Sep. 13, 2007.

Communication re: Supplemental European Search Report dated Aug. 11, 2009.

* cited by examiner

LIQUID EJECTOR AND METHOD FOR EJECTING LIQUID

RELATED APPLICATION DATA

The application is a divisional application of U.S. patent application Ser. No. 10/531,511, filed Feb. 6, 2006, which is incorporated herein by reference in its entirety to the extent permitted law. Application Ser. No. 10/531,511 is a national phase application under 37 U.S.C. 371 of PCT/JP03/13316 filed Oct. 17, 2003. The present application also claims priority to Japanese Serial No. P2002-303913 filed Oct. 18, 2002 and Japanese Serial No. P2003-153320 filed May 29, 2003.

BACKGROUND OF THE INVENTION

The present invention relates to a liquid discharge apparatus and liquid discharge method for determining a liquid discharge deflection amount in accordance with the distance between a head's liquid discharge surface and a surface on which a discharged liquid is to land, and deflecting and discharging a liquid in accordance with the determined liquid discharge deflection amount.

A known example of a liquid discharge apparatus having a head in which a plurality of nozzle-incorporated liquid discharge sections are arranged is an inkjet printer. A thermal method is known as an ink discharge method for inkjet printers. The thermal method is used to discharge ink by making use of thermal energy.

A known structure employed for an ink discharge section based on the thermal method includes an ink liquid chamber, a thermal resistor provided in the ink liquid chamber, and a nozzle mounted on the ink liquid chamber. Ink in the ink liquid chamber is rapidly heated by the thermal resistor to form bubbles in the ink on the thermal resistor. Energy generated upon bubble formation discharges the ink (ink droplets) from the nozzle in the ink discharge section.

From the viewpoint of a head structure, two ink discharge methods are defined: serial method and line method. The serial method is used to make a print while moving the head in the direction of the width of print paper. The line method is used while many heads are arranged in the direction of the width of print paper to form a line head that covers the whole print paper width.

In a known line head structure disclosed a plurality of small head chips are positioned end to end so that liquid discharge sections of the head chips are arrayed to cover the whole print paper width. (for instance, by Japanese Patent Laid-open No. 2002-36522). A known technology disclosed, provides a printer head structure in which a plurality of heaters are variously positioned within an ink liquid chamber corresponding to one nozzle so as to vary the angle of ink droplet discharge. This ensures that diversified ink landing positions are rendered inconspicuous. (for instance, by Japanese Patent Laid-open No. 2002-240287). However, the above conventional technologies have problems that are described below.

When the ink is to be discharged from a head, it is ideal that the ink be discharged perpendicularly to the discharge surface. Due to various causes, however, the ink may not always be discharged perpendicularly to the discharge surface.

When, for instance, a nozzle sheet on which a nozzle is formed is to be attached to the upper surface of the ink liquid chamber having a thermal resistor, the correct positional relationship among the ink liquid chamber, thermal resistor, and nozzle needs to be observed. When the nozzle sheet is attached so that the nozzle center is in alignment with the center of the ink liquid chamber and thermal resistor, the ink will be discharged perpendicularly to the discharge surface. However, if the nozzle center is not in alignment with the center of the ink liquid chamber and thermal resistor, the ink will not be discharged perpendicularly to the discharge surface.

Positional displacement may also occur due to a thermal expansion coefficient difference among the ink liquid chamber, thermal resistor, and nozzle sheet.

When discharged perpendicularly to the discharge surface, the ink lands at a correct position. However, if the ink is not discharged perpendicularly to the discharge surface, the resulting ink landing position is displaced. If the ink landing position is displaced during the use of the serial method, ink landing pitch displacement occurs between nozzles. If, on the other hand, the ink landing position is displaced during the use of the line method, ink landing position displacement occurs between arrayed heads in addition to the above-mentioned ink landing pitch displacement.

More specifically, if the ink landing positions provided by adjacent heads are displaced away from each other, the ink is not discharged to a certain area between the heads. Further, the line head does not move in the direction of the width of print paper. Therefore, a white streak appears between the heads to the detriment of print quality.

On the other hand, if the ink landing positions provided by adjacent heads are displaced toward each other, dots overlap in a certain area between the heads. Consequently, a discontinuous print image or an unduly dark streak may result to the detriment of print quality.

Technologies are therefore proposed by the applicant of the present invention to solve the above problems (e.g., Japanese Patent Application No. 2002-112947 and Japanese Patent Application No. 2002-161928). These technologies utilize a technology disclosed by Japanese Patent Laid-open No. 2002-240287, which is mentioned above, and make it possible to control (deflect) the liquid discharge direction in a liquid discharge apparatus that has a head in which a plurality of liquid discharge sections are arrayed.

However, if the same deflection angle is employed for the ink discharge direction in a situation where the print paper thickness varies or the distance (gap) between the ink discharge surface and ink landing surface of print paper varies, the above technologies do not cause the ink to land at precise positions.

FIGS. 17A and 17B illustrate prints that are made on print papers P1 and P2, which differ in paper thickness, with the ink discharge angle deflected by $\alpha$ FIG. 17A indicates that a print is made on print paper P1 with the ink discharge angle deflected by $\alpha$ when the distance between the ink discharge surface (the end face of head 1) and the ink landing surface of print paper P1 is L1.

When head 1, which has the above characteristics, is used with print paper P2, which differs from print paper P1 in paper thickness (print paper P2 is thicker than print paper P1), the distance between the ink discharge surface and the ink landing surface of print paper P2 changes from L1 to L2 (L2<L1). If the ink discharge angle is similarly deflected by $\alpha$ in the resulting state, the ink landing positions differ from those prevailing when print paper P1 is used.

In some cases, the surface height of a single sheet of print paper may partly vary if, for instance, an envelope having a fold or label print paper is used. Further, if a printed circuit board containing a circuit pattern is used, the surface height considerably varies. Furthermore, if the employed print paper has a curled edge, the surface height of such a curled edge differs from that of the other portion.

In the above cases, print paper and other similar materials having varying surface heights cannot be properly printed even if the ink discharge angle is properly adjusted prior to printing.

SUMMARY OF THE INVENTION

Accordingly, it is an object of the present invention to include a head in which a plurality of liquid discharge sections are arrayed, and incorporate a function for deflecting the direction of liquid discharge. Even when the distance between the liquid discharge surface and the liquid landing surface of a liquid discharge target (to which the liquid is to be discharged) varies, the present invention should be capable of setting an appropriate deflection amount. Further, even when the surface height of a single liquid discharge target varies, the present invention should be capable of performing appropriate deflection amount setup accordingly.

In accomplishing the above objects, according to one aspect of the present invention, there is provided a liquid discharge apparatus including a head in which a plurality of nozzle-incorporated liquid discharge sections are arrayed; discharge direction deflection means for deflecting the discharge direction of a liquid discharged from a nozzle of each liquid discharge section in the direction of the array of the liquid discharge sections; distance detection means for detecting the distance between the liquid discharge surface of the head and the liquid landing surface of a liquid discharge target; and discharge deflection amount determination means for determining the amount of liquid discharge deflection to be provided by the discharge direction deflection means in accordance with the result of detection by the distance detection means.

In the above aspect of the present invention, the discharge direction deflection means is capable of deflecting the liquid discharge direction from the nozzle of each liquid discharge section. To determine the discharge deflection amount, the distance detection means detects the distance between the liquid discharge surface of the head and the liquid landing surface of the liquid discharge target. In accordance with the detection result, the discharge deflection amount determination means determines the amount of liquid discharge deflection.

As a result, the present invention is capable of setting an appropriate deflection amount even when the distance between the liquid discharge surface of the head and the liquid landing surface of the liquid discharge target varies.

According to another aspect of the present invention, there is provided a liquid discharge apparatus including a head in which a plurality of nozzle-incorporated liquid discharge sections are arrayed; discharge direction deflection means for deflecting the discharge direction of a liquid discharged from a nozzle of each liquid discharge section in a plurality of directions of the array of the liquid discharge sections; relative movement means for relatively moving the head and a liquid discharge target on which the liquid discharged from the nozzle of each liquid discharge section is to land; distance detection means, which exists on the side on which the relative movement means loads the liquid discharge target relative to the head, emits a material wave to the liquid discharge target, receives the resulting reflected wave, detects the distance between the liquid discharge surface of a liquid discharge section and the liquid landing surface of a liquid discharge target in accordance with the received reflected wave, and sequentially detects the distance while the relative movement means relatively moves the head and liquid discharge target; a data table for defining the discharge deflection amount of the liquid to be discharged from the nozzle of each liquid discharge section in relation to the distance and a landing target position of the liquid to be discharged from the nozzle of each liquid discharge section; and discharge deflection amount determination means for referencing the data table and determining the amount of liquid discharge deflection to be provided by the discharge direction deflection means corresponding to each liquid discharge section from the distance detected by the distance detection means and the landing target position of the liquid.

In the above aspect of the present invention, the discharge direction deflection means is capable of deflecting the liquid discharge direction from the nozzle of each liquid discharge section. To determine the discharge deflection amount, the distance detection means detects the distance between the liquid discharge surface of the head and the liquid landing surface of the liquid discharge target. Further, the distance detection means emits a material wave to the liquid discharge target to detect the distance, and sequentially detects the distance while the head and liquid discharge target relatively move. The distance detection means achieves sequential distance detection by detecting the distance without coming into contact with the liquid discharge target. Therefore, the distance detection means is capable of constantly detecting the distance. Since the distance is sequentially detected while the head and liquid discharge target relatively move, the distance detection means can immediately detect a change in the Meanwhile, the data table defines the discharge deflection amount in relation to the distance and the landing target position of the liquid to be discharged from the nozzle of each liquid discharge section.

The discharge deflection amount determination means references the data table and determines the discharge deflection amount for each liquid discharge section from the detected distance and the landing target position of the liquid. Therefore, the present invention is capable of setting an appropriate deflection amount even when the distance between the liquid discharge surface of the head and the liquid landing surface of the liquid discharge target varies in accordance with the relative movement of the head and liquid discharge target.

According to still another aspect of the present invention, there is provided a liquid discharge apparatus including a head in which a plurality of nozzle-incorporated liquid discharge sections are arrayed; discharge direction deflection means for deflecting the discharge direction of a liquid discharged from a nozzle of each liquid discharge section in a plurality of directions of the array of the liquid discharge sections; relative movement means for relatively moving the head and a liquid discharge target on which the liquid discharged from the nozzle of each liquid discharge section is to land; distance information acquisition means for acquiring distance information about the distance between the liquid discharge surface of a liquid discharge section and the liquid landing surface of a liquid discharge target while the relative movement means relatively moves the head and liquid discharge target; a data table for defining the discharge deflection amount of the liquid to be discharged from the nozzle of each liquid discharge section in relation to the distance between the liquid discharge surface of a liquid discharge section and the liquid landing surface of the liquid discharge target and a landing target position of the liquid to be discharged from the nozzle of each liquid discharge section; and discharge deflection amount determination means for referencing the data table and determining the amount of liquid discharge deflection to be provided by the discharge direction deflection means corresponding to each liquid discharge section from the distance information acquired by the distance information acquisition means and the landing target position of the liquid.

In the above aspect of the present invention, the discharge direction deflection means is capable of deflecting the liquid discharge direction from the nozzle of each liquid discharge section. To determine the discharge deflection amount, the liquid discharge apparatus causes the distance information acquisition means to acquire distance information about the distance between the liquid discharge surface of a liquid discharge section and the liquid landing surface of the liquid discharge target in accordance with the relative movement of the head and liquid discharge target. The distance information acquisition means acquires the distance information when the distances to various positions of the liquid discharge target, such as a printed circuit board containing a circuit pattern, are known.

Meanwhile, the data table defines the discharge deflection amount in relation to the distance and the landing target position of the liquid to be discharged from the nozzle of a liquid discharge section.

The discharge deflection amount determination means references the data table and determines the discharge deflection amount for each liquid discharge section from the acquired distance information and the landing target position of the liquid. If, for instance, the distances to various positions of the liquid discharge target are known, the present invention is therefore capable of setting an appropriate deflection amount without having to perform a distance detection procedure even when the distance between the liquid discharge surface of the head and the liquid landing surface of the liquid discharge target varies in accordance with the relative movement of the head and liquid discharge target.

BRIEF DESCRIPTION OF THE DRAWINGS

FIG. 6A relates to a situation where distance H=L1, whereas FIG. 6B relates to a situation where distance H=L2.

DETAILED DESCRIPTION OF THE PRESENTLY PREFERRED EMBODIMENTS

One embodiment of the present invention will now be described with reference to the accompanying drawings.

First Embodiment

Figure 1:
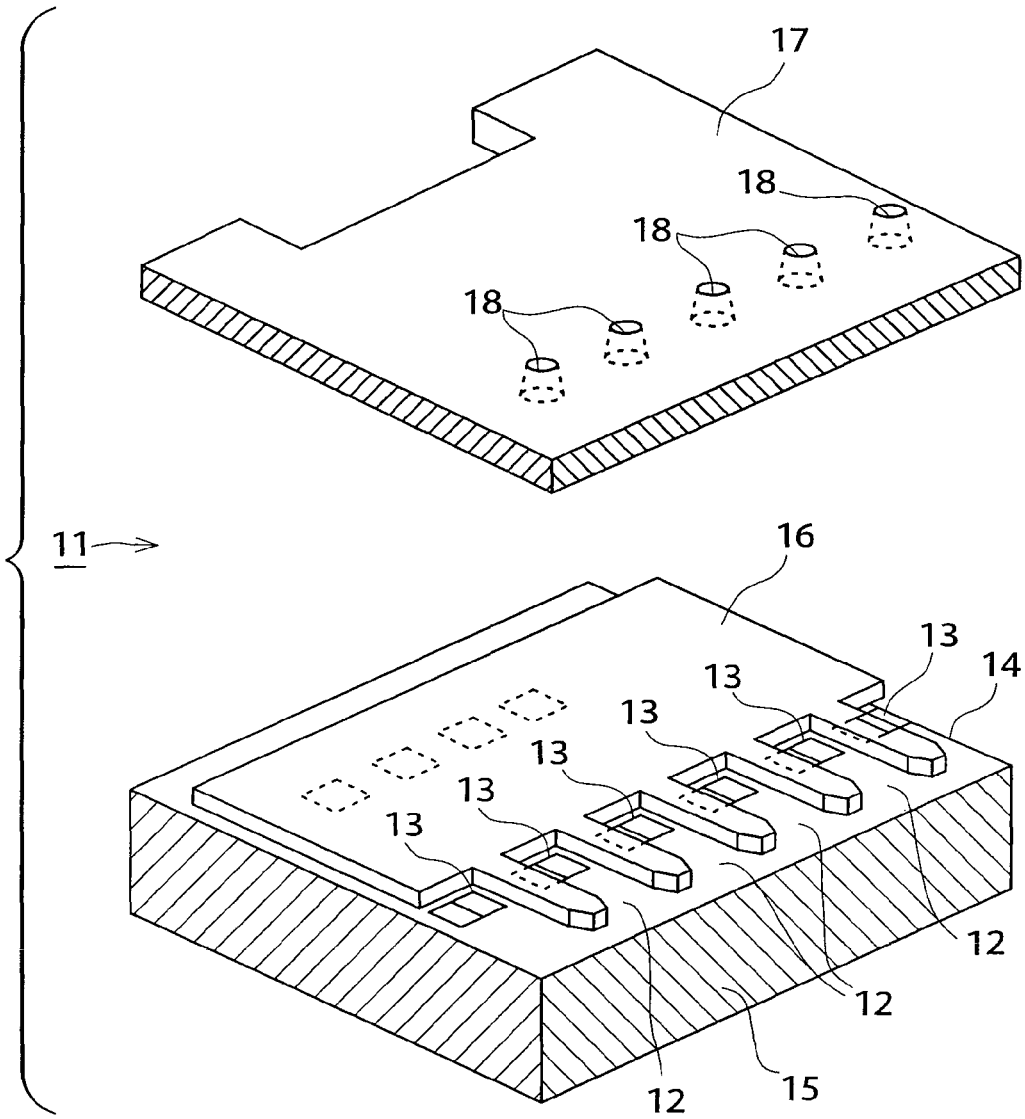
FIG. 1 is an exploded perspective view illustrating a head of an inkjet printer to which a liquid discharge apparatus according to the present invention is applied.

FIG. 1 is an exploded perspective view illustrating a head 11 of an inkjet printer (hereinafter abbreviated to the "printer") to which a liquid discharge apparatus according to the present invention is applied. A nozzle sheet 17 is attached to a barrier layer 16. However, FIG. 1 shows an exploded view of the nozzle sheet 17.

Within the head 11, a substrate member 14 includes a semiconductor substrate 15, which is made of silicon and the like, and a thermal resistor 13, which corresponds to energy generation means according to the present invention and is deposited on one surface of the semiconductor substrate 15. The thermal resistor 13 is electrically connected to an aftermentioned circuit via a conductive section (not shown) that is formed on the semiconductor substrate 15.

The barrier layer 16 is made, for instance, of a dry film resist that hardens upon exposure. It is first formed on the entire surface of the thermal resistor 13 for the semiconductor substrate 15. Then, an unnecessary portion of it is eliminated by a photolithographic process.

The nozzle sheet 17 contains a plurality of nozzles 18. It is formed, for instance, by using a nickel-based electroforming technique. It is attached to the barrier layer 16 so that the position of the nozzles 18 coincides with the position of the thermal resistor 13, that is, the nozzles 18 face the thermal resistor 13.

An ink liquid chamber 12 (which corresponds to a liquid chamber according to the present invention) encloses the thermal resistor 13 and includes the substrate member 14, barrier layer 16, and nozzle sheet 17. More specifically, the substrate member 14 forms a bottom wall for the ink liquid chamber 12; the barrier layer 16 forms a side wall for the ink liquid chamber 12; and the nozzle sheet 17 forms a top wall for the ink liquid chamber 12. The ink liquid chamber 12 has an opening, which is positioned on the front right-hand side in FIG. 1 and communicated with an ink flow path (not shown).

The head 11 usually includes hundreds of thermal resistors 13 and ink liquid chambers 12, which include the thermal resistors 13. In compliance with a command from a printer control section, the head 11 selects appropriate thermal resistors 13 and causes nozzles 18 facing the ink liquid chambers 12 to discharge ink from ink liquid chambers 12 corresponding to the selected thermal resistors 13.

The ink is supplied from an ink tank (not shown), which is coupled to the head 11, to fill the ink liquid chambers 12. A pulse current flows to the thermal resistors 13 for a short period of time of, for instance, 1 to 3 μ.sec. The thermal resistors 13 are then rapidly heated. Consequently, bubbles of ink vapor are generated in sections in contact with the thermal resistors 13. The generated ink bubbles then expand to drive out a certain volume of ink (the ink boils). As a result, the nozzles 18 discharge the ink as droplets, which land on print paper (liquid discharge target). The volume of the discharged ink is virtually the same as the volume of the ink that is driven out and in contact with the nozzles 18.

In this description, a portion including an ink liquid chamber 12, a thermal resistor 13 positioned within the ink liquid chamber 12, and a nozzle 18 positioned on the top of the thermal resistor 13 is referred to as the. "ink discharge section (liquid discharge section)". In the head 11, a plurality of ink discharge sections are arrayed.

In the present embodiment, a plurality of heads 11 are arranged in the direction of the print paper width to form a line head. In this instance, a plurality of head chips (heads 11 without the nozzle sheet 17) are first arranged, and then one nozzle sheet 17 (which has nozzles 18 that are positioned to match all the ink liquid chambers 12 of each head chip) is attached to form the line head.

Figure 2:
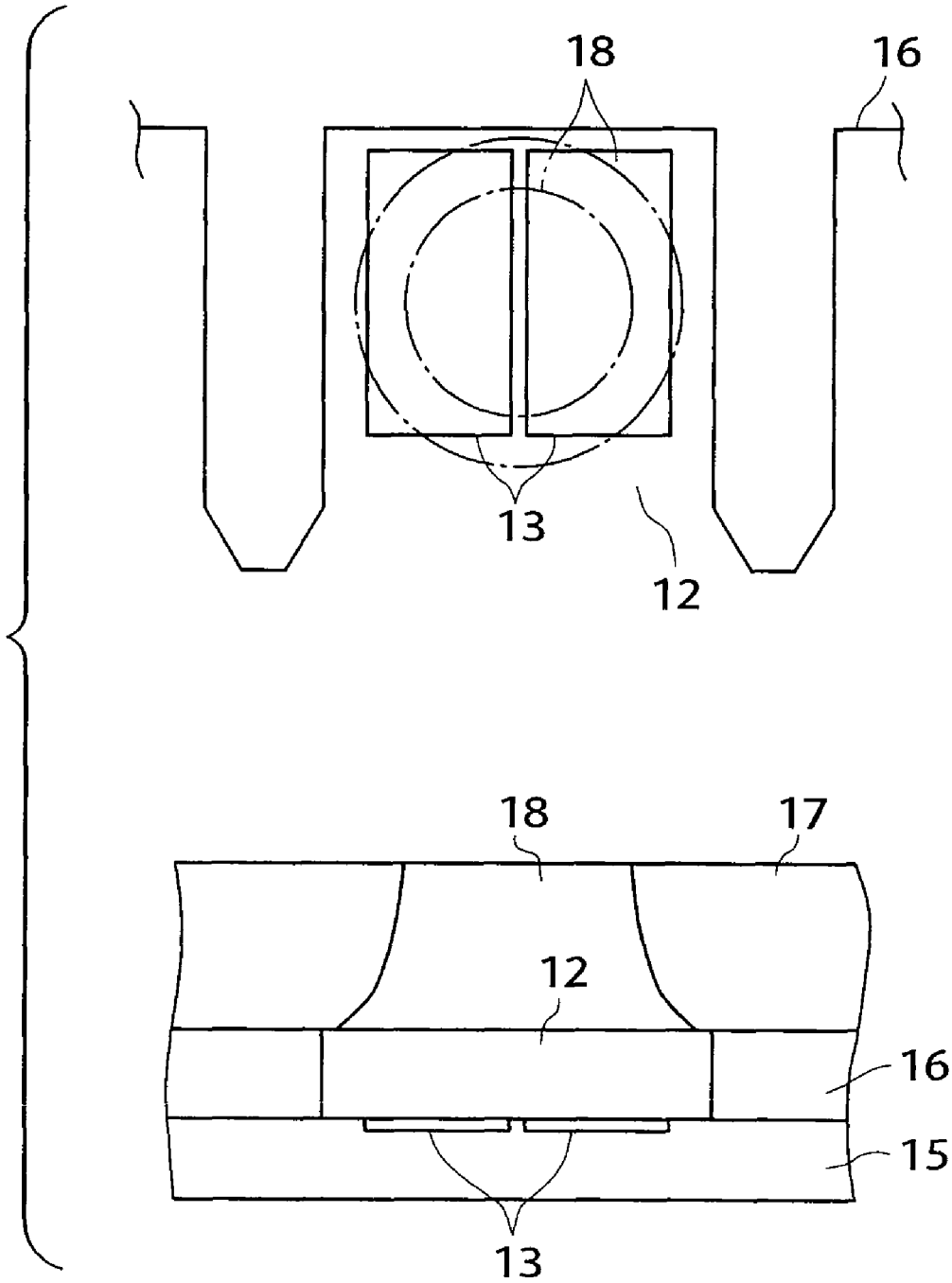
FIG. 2 shows a plan view and cross-sectional side view that illustrate in detail the thermal resistor layout of an ink discharge section.

FIG. 2 shows a plan view and cross-sectional side view that illustrate in detail the thermal resistor 12 layout of the ink discharge section. Within the plan view in FIG. 2, a nozzle 18 is indicated by a one-dot chain line.

As indicated in FIG. 2, the present embodiment assumes that two split thermal resistors 13 are arranged within a single ink liquid chamber 12. The two split thermal resistors are arranged in the direction in which the nozzles 18 are arranged (left-right direction in FIG. 2).

When one thermal resistor 13 is vertically split into two segments, the thermal resistor width is reduced to half while the length remains unchanged. Therefore, the resistance value of the resulting thermal resistors 13 becomes twofold. When the two split thermal resistors 13 are series-connected, it means that the thermal resistors 13 having a twofold resistance value are series-connected. Therefore, the resistance value becomes fourfold (this value is a calculated value that is obtained when the distance between the arrayed thermal resistors 13 in FIG. 2 is not taken into account).

To boil the ink in the ink liquid chamber 12, it is necessary to heat the thermal resistors 13 by applying certain electrical power to the thermal resistors 13. The purpose is to discharge the ink by making use of energy that is generated upon boiling. If the resistance value is small, it is necessary to increase the electrical current. However, when the resistance values of the thermal resistors 13 are increased, the ink can be boiled with a small electrical current.

The sizes of a transistor and other devices for flowing an electrical current can then be decreased to provide increased space savings. When the thickness of the thermal resistors 13 is decreased, it is possible to increase the resistance value. However, when materials selected for the thermal resistors 13 and their strength (durability) are considered, the thickness of the thermal resistors 13 cannot be decreased beyond a certain limit. Under these circumstances, the resistance values of the thermal resistors 13 are increased by splitting the thermal resistors and not by reducing their thickness.

When the two split thermal resistors 13 are positioned within a single ink liquid chamber 12, the bubble generation time, which is required for the thermal resistors 13 to heat the ink to its boiling temperature, is usually set so that the thermal resistors 13 simultaneously heat the ink to its boiling temperature. If the two thermal resistors 13 differ in the bubble generation time, the ink discharge angle is not vertical so that the ink discharge direction deflects.

Figure 3:
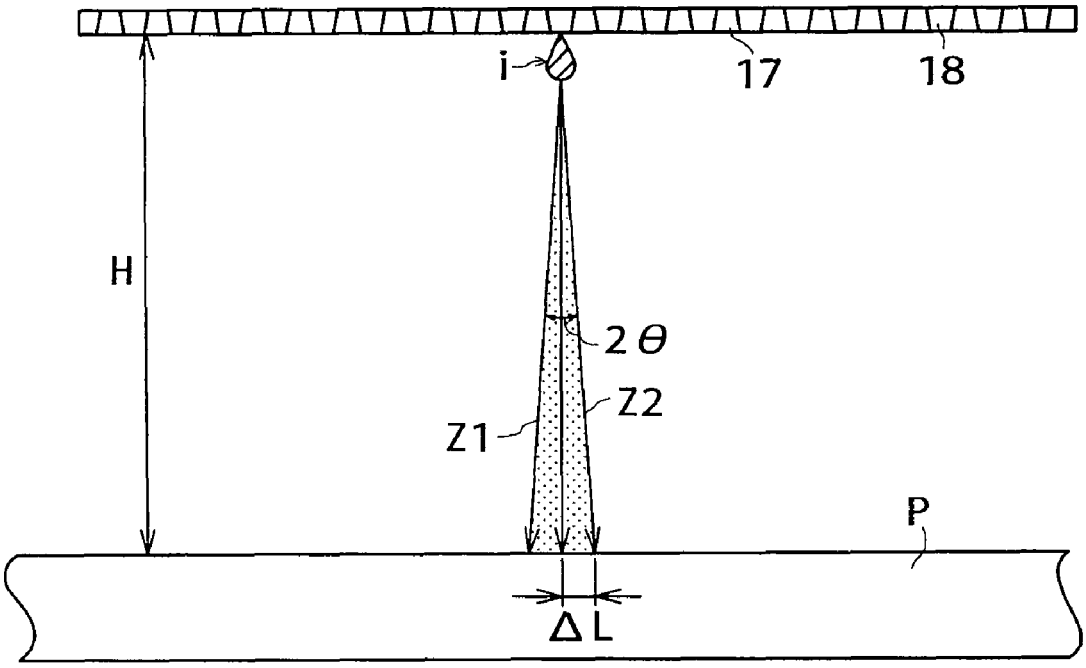
FIG. 3 illustrates how the ink discharge direction is deflected.

FIG. 3 illustrates the ink discharge direction. When, in FIG. 3, ink i is discharged vertically to the discharge surface of the ink i (the surface of print paper P), the ink i is discharged in the direction indicated by a broken line and without being deflected. However, if the ink discharge direction is deflected so that the discharge angle deviates from the vertical by θ (in direction Z1 or Z2 in FIG. 3), the landing position of the ink i is displaced as indicated below:

$$\Delta L = H \times \tan\theta$$

The symbol H denotes the distance between the end of a nozzle 18 and the surface of print paper P, that is, the distance between the ink discharge surface of a liquid discharge section and the ink landing surface. For common inkjet printers, the distance H is approximately 1 to 2 mm. It is therefore assumed that the distance H is maintained at approximately 2 mm.

The distance H needs to be maintained substantially constant. The reason is that if the distance H varies, the landing position of the ink i varies. In other words, when the ink i is discharged vertically to the surface of print paper P, the landing position of the ink i does not vary even if the distance H slightly varies. If, on the other hand, the ink i is deflected when it is discharged as described above, the landing position of the ink i varies in accordance with a change in the distance H.

Figure 4A:
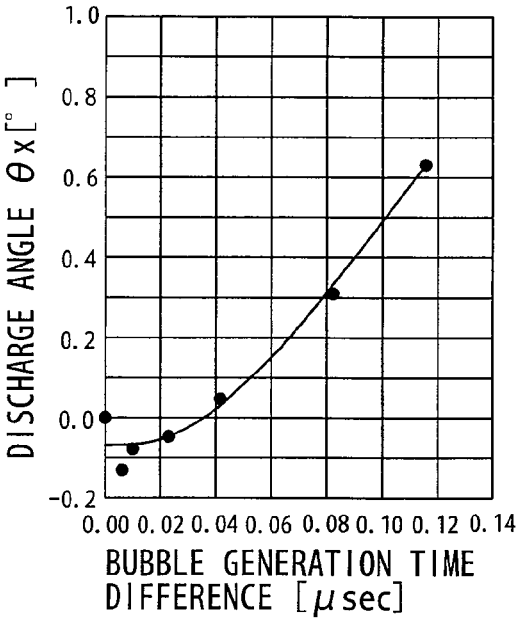
FIGS. 4A and 4B are graphs illustrating the relationship between the ink bubble generation time difference of two split thermal resistors and the angle of ink discharge.
Figure 4B:
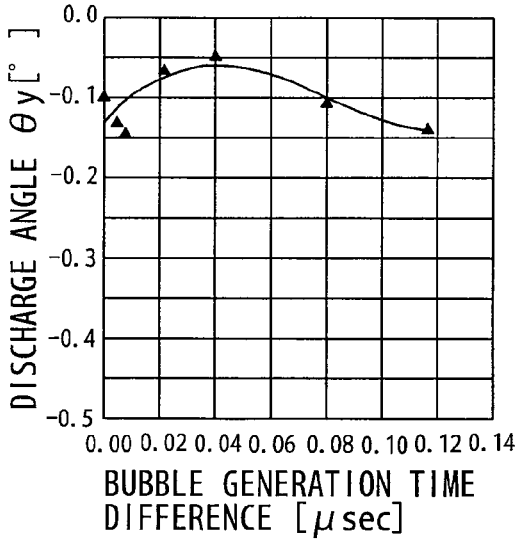
Figure 4C:
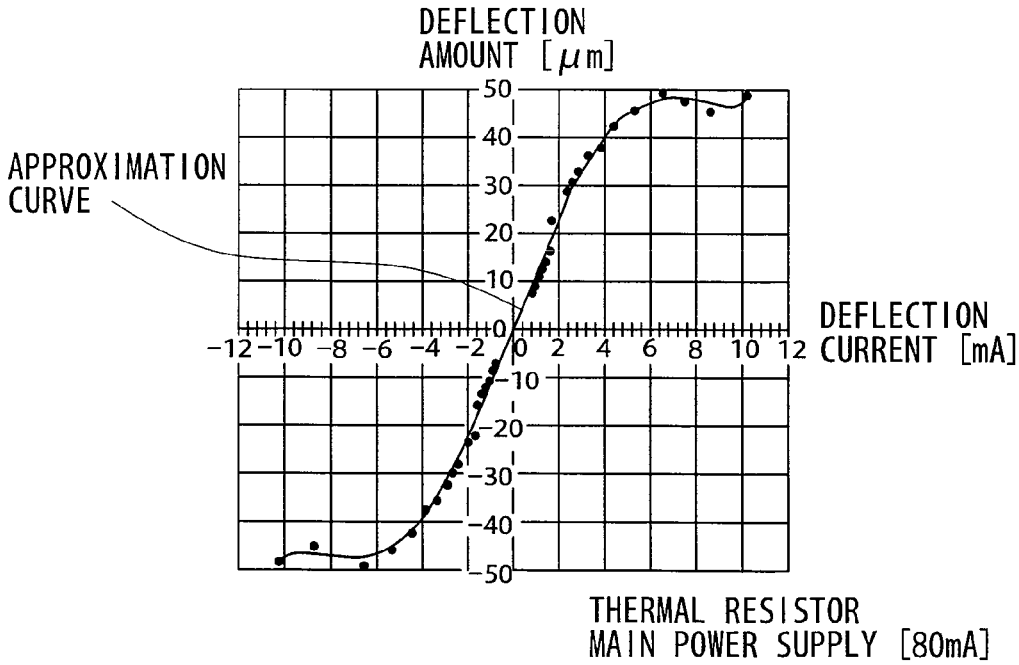
FIG. 4C shows measured data concerning the ink bubble generation time difference of two split thermal resistors.

FIGS. 4A and 4B are graphs illustrating the relationship between the ink bubble generation time difference of two split thermal resistors 13 and the angle of ink discharge. The graphs represent the results of computation simulation. In the graphs, the X-direction is the arrangement direction of nozzles 18 (the array direction of thermal resistors 13), whereas the Y-direction is perpendicular to the X-direction (the direction of print paper transport). FIG. 4C is a graph that shows measured data. To show the ink bubble generation time difference between the two split thermal resistors 13, the horizontal axis of the graph indicates half the electrical current difference between the two split thermal resistors 13 as a deflection current. The vertical axis of the graph indicates the amount of ink landing position displacement (measurements are made on the assumption that the distance between the ink discharge surface and the ink landing position on print paper is approximately 2 mm). FIG. 4C illustrates an ink deflective discharge operation in which the above deflection current is superposed on one of the two split thermal resistors 13 while a main current of 80 mA flows to the thermal resistors 13.

If there is a bubble generation time difference between the two split thermal resistors 13 that are arranged in the array direction of the nozzles 18, the ink discharge angle is not vertical as indicated in FIGS. 4A through 4C. The ink discharge angle θ× in the array direction of the nozzles 18 (which is the amount of deviation from the vertical and corresponds to the symbol θ in FIG. 3) increases with an increase in the bubble generation time difference.

The present embodiment makes use of the above characteristic. The present embodiment provides two split thermal resistors 13 and varies the amounts of electrical current flows to the thermal resistors 13 so that there arises a bubble generation time difference between the two thermal resistors 13.

In this manner, the present embodiment deflects the ink discharge direction (discharge direction deflection means).

If the resistance values of the two split thermal resistors 13 are not equal due, for instance, to a manufacturing error, there arises a bubble generation time difference between the two thermal resistors 13. Therefore, the ink discharge angle is not vertical so that the ink landing position deviates from normal. However, when the amounts of electrical current flows to the two split thermal resistors 13 are varied to control the bubble generation time of each thermal resistor 13 until the two thermal resistors 13 are equal in the bubble generation time, the ink discharge angle can be rendered vertical.

When, for instance, the ink discharge direction is deflected from the original discharge direction for one or two or more particular heads 11 of a line head, the discharge direction can be corrected for a head 11 that does not discharge ink vertically onto the landing surface of print paper due, for instance, a manufacturing error. Thus, the ink can be discharged vertically.

Further, only the ink discharge directions of one or two or more particular ink discharge sections of one head 11 can be deflected. For example, if the direction of ink discharge from a particular ink discharge section is not parallel to the direction of ink discharge from the other ink discharge sections, it is possible to deflect only the direction of ink discharge from that particular ink discharge section until the resulting ink discharge direction is parallel to the direction of ink discharge from the other ink discharge sections.

Moreover, the ink discharge direction can be deflected as described below.

When, for instance, ink is to be discharged, without being deflected, from ink discharge section N and from ink discharge section (N+1), which is adjacent to ink discharge section N, it is assumed that the inks discharged from ink discharge section N and ink discharge section (N+1) reach landing position n and landing position (n+1), respectively. In this instance, the ink can be discharged from ink discharge section N, without being deflected, until it reaches landing position n. It is also possible to deflect the ink discharge direction so that the ink discharged from ink discharge section N reaches landing position (n+1).

Similarly, the ink can be discharged from ink discharge section (N+1), without being deflected, until it reaches landing position (n+1). It is also possible to deflect the ink discharge direction so that the ink discharged from ink discharge section (N+1) reaches landing position n.

If the ink cannot be discharged due, for instance, to a clog in ink discharge section (N+1), the ink does not reach landing position (n+1) under normal conditions. The employed head 11 is then considered to be defective because of the loss of a dot.

In the above situation, however, the ink discharged from ink discharge section N, which is adjacent to one side of ink discharge section (N+1), or from ink discharge section (N+2), which is adjacent to the other side of ink discharge section (N+1), can be deflected so that it reaches landing position (n+1).

The discharge direction deflection means will now be described in detail. The discharge direction deflection means according to the present embodiment includes a current mirror circuit (hereinafter referred to as the CM circuit).

Figure 5:
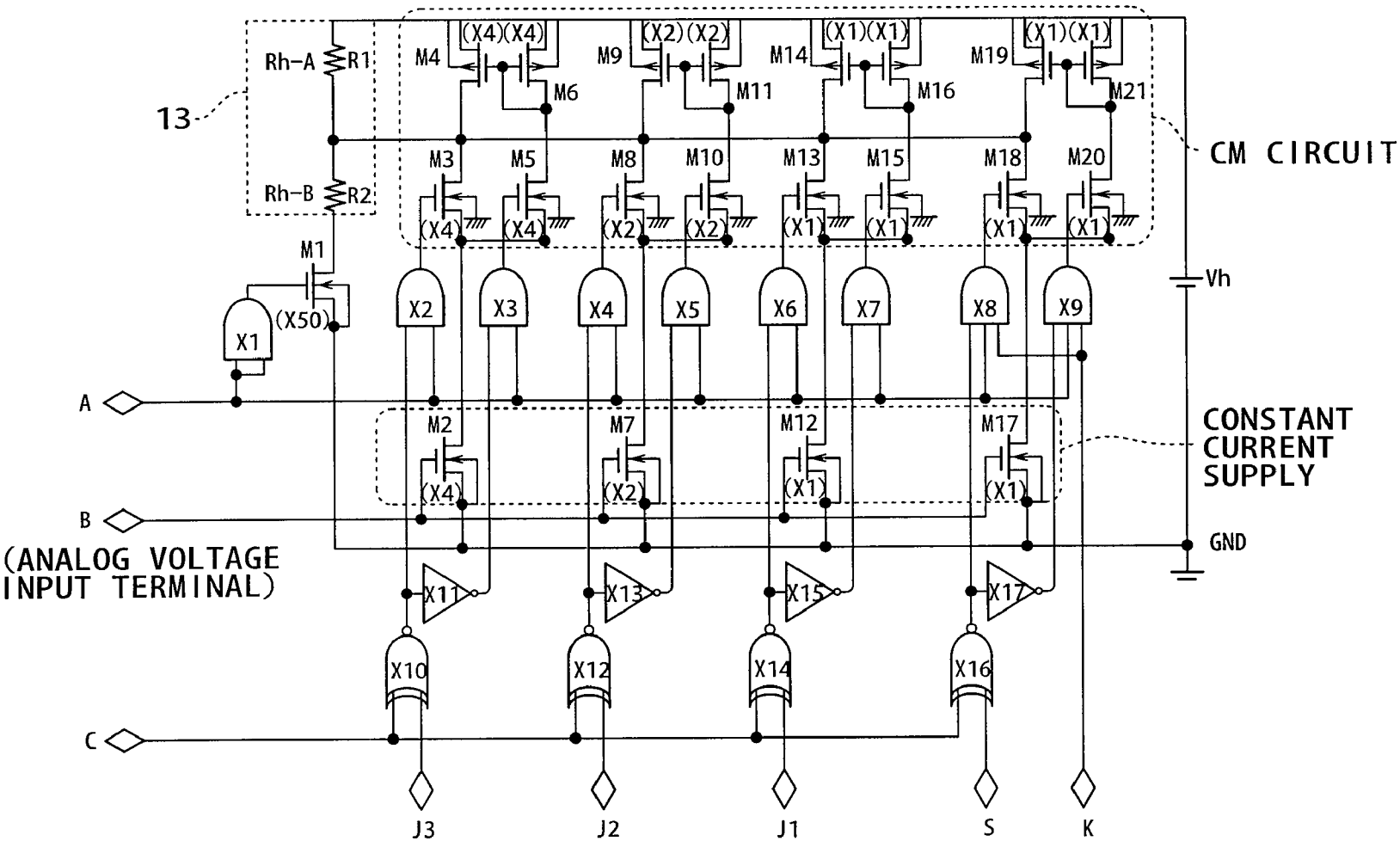
FIG. 5 is a circuit diagram that illustrates discharge direction deflection means.

FIG. 5 is a circuit diagram that illustrates the discharge direction deflection means according to the first embodiment. The elements used in the illustrated circuit and the circuit connection will now be described.

Resistors Rh-A and Rh-B, which are shown in FIG. 5, are the aforementioned two split thermal resistors 13. These resistors are series-connected. A resistor power supply Vh is provided to apply a voltage to resistors Rh-A and Rh-B.

The circuit shown in FIG. 5 includes transistors M1 through M21. Transistors M4, M6, M9, M11, M14, M16, M19, and M21 are PMOS transistors. The other transistors are NMOS transistors. Within the circuit shown in FIG. 5, transistors M2, M3, M4, M5, and M6 compose a CM circuit. The circuit shown in FIG. 5 includes a total of four CM circuits.

In the circuit, the gate and drain of transistor M6 and the gate of transistor M4 are connected. Further, the drains of transistors M4 and M3 and the drains of transistors M6 and M5 are interconnected, respectively. This also holds true for the other CM circuits.

The drains of transistors M4, M9, M14, and M19, which are included in the CM circuits, and the drains of transistors M3, M8, M13, and M18 are connected to a midpoint between resistors Rh-A and Rh-B.

Transistors M2, M7, M12, and M17 respectively serve as a constant current supply for the CM circuits. Their drains are connected to the sources of transistors M3, M8, M13, and M18, respectively.

The drain of transistor M1 is series-connected to resistor Rh-B. When a discharge execution input switch A turns ON (1), transistor M1 turns ON so that a current flows to resistors Rh-A and Rh-B.

The output terminals of AND gates X1 through X9 are respectively connected to the gates of transistors M1, M3, M5, and so on to M20. AND gates X1 through X7 are of the two-input type, whereas AND gates X8 and X9 are of the three-input type. At least one input terminal of AND gates X1 through X9 is connected to the discharge execution input switch A.

One of the input terminals for XNOR gates X10, X12, X14, and X16 is connected to a deflection direction selector switch C. Another input terminal is connected to a deflection control switch J1, J2, or J3 or discharge angle correction switch S.

The deflection direction selector switch C selects a direction (nozzle array direction) in which the ink discharge direction to be deflected. When the deflection direction selector switch turns ON (1), one input of XNOR gate X10 is set to 1.

Deflection control switches J1 through J3 are used to determine the amount of ink discharge direction deflection. If, for instance, deflection control switch J3 turns ON (1), one input of XNOR gate X10 is set to 1.

The output terminals of XNOR gates X10 through X16 are connected to one input terminal of AND gates X2, X4, and so on to X8, and connected to one input terminal of AND gates X3, X5, and so on to X9 via NOT gates X11, X13, and so on to X17. One input terminal of AND gates X8 and X9 is connected to discharge angle correction switch K.

A deflection amplitude control terminal B is used to determine the amplitude of a single deflection step. It determines an electrical current value for transistors M2, M7, and so on to M17, which serve as constant current supplies for the CM circuits, and is connected to the gates of transistors M2, M7, and so on to M17. The deflection amplitude can be set to 0 by setting this terminal to 0V. When this terminal is set to 0V, the electrical current of the current supply is set to 0 so that no deflection current flows, thereby setting the amplitude to 0. When the voltage of this terminal is gradually raised, the current value gradually increases so that a larger amount of deflection current flows, thereby increasing the deflection amplitude.

In other words, the proper deflection amplitude can be maintained by controlling the voltage to be applied to this terminal.

The source of transistor M1, which is connected to resistor Rh-B, and the sources of transistors M2, M7, and so on, which serve as the constant current supplies for the CM circuits, are shorted to a ground (GND).

Within the above configuration, parenthesized numbers (×(N=1, 2, 4, or 50)) for transistors M1 through M21 indicate parallel element connections. For example, the symbol "×1" (M12 to M21) indicates that a standard element is provided. The symbol "×2" (M7 to M11) indicates that the provided element is equivalent to a parallel connection of two standard elements. The symbol "×N" indicates that the provided element is equivalent to a parallel connection of N standard elements.

The parenthesized numbers for transistors M2, M7, M12, and M17 are "×4", "×2", "×1", and "×1", respectively. Therefore, when an appropriate voltage is applied between the gates of these transistors and the ground, the drain currents for the transistors are at a ratio of 4:2:1:1.

The operation of the circuit shown in FIG. 5 will now be described. At first, however, attention is focused only on a CM circuit that includes transistors M3, M4, M5, and M6.

The discharge execution input switch A turns ON (1) only when ink is to be discharged.

When, for instance, A=1, B=2.5 V applied, C=1, and J3=1, the output of XNOR gate X10 is 1. This output 1 and the value A=1 enter AND gate X2. Then, the output of AND gate X2 is 1. Thus, transistor M3 turns ON.

When the output of XNOR gate X10 is 1, the output of NOT gate X11 is 0. This output 0 and the value A=1 enter AND gate X3. Then, the output of AND gate X3 is 0. Thus, transistor M5 turns OFF.

The drains of transistors M4 and M3 are interconnected and the drains of transistors M6 and M5 are interconnected. Therefore, when transistor M3 is ON with M5 turned OFF as described above, a current flows from transistor M4 to transistor M3; however, no current flows from transistor M6 to transistor M5. The CM circuit characteristics are such that when no current flows to transistor M6, no current flows to transistor M4 either. Further, a voltage of 2.5 V is applied to the gate of transistor M2. In the above case, therefore, a current according to such a voltage application flows from transistor M3 to transistor M2 and no current flows from transistor M4, M5, or M6.

In the state described above, the gate of transistor M5 is OFF. Therefore, no current flows to transistor M6. No current flows to transistor M4 either because it is a mirror for the current flowing to transistor M6. Intrinsically, the same current $I_h$ flows to resistors Rh-A and Rh-B. However, when the gate of transistor M3 is ON, the current value determined by transistor M2 is derived from a midpoint between resistors Rh-A and Rh-B via transistor M3. Therefore, the current value determined by transistor M2 is added to only the current flowing to resistor Rh-A. Consequently, $I_{Rh\text{-}A}>I_{Rh\text{-}B}$.

The above description deals with a case where C=1. A case where C=0, that is, only the input of the deflection direction selector switch C is different (the other switches A, B and J3 are 1 as described above), will now be described.

When C=0 and J3=1, the output of XNOR gate X10 is 0. Then, the input of AND gate X2 is (0, 1 (A=1)). Thus, its output is 0. Consequently, transistor M3 is OFF.

When the output of XNOR gate X10 is 0, the output of NOT gate X1 is 1. Then, the input of AND gate X3 is (1, 1 (A=1)). Consequently, transistor M5 is ON.

While transistor M5 is ON, a current flows to transistor M6. Then, due to the CM circuit characteristics, a current flows to transistor M4 as well.

The resistor power supply Vh then invokes a current flow to resistor Rh-A, transistor M4, and transistor M6. The current flowing to resistor Rh-A entirely flows to resistor Rh-B (the current flowing out of resistor Rh-A does not branch to transistor M3 because it is OFF). The current flowing to transistor M4 entirely flows to resistor Rh-B because transistor M3 is OFF. The current flowing to transistor M6 flows to transistor M5.

As indicated above, when C=1, the current flowing to resistor Rh-A branches out to resistor Rh-B and transistor M3. However, when C=0, the current flowing to resistor Rh-A and the current flowing to transistor M4 both flow to resistor Rh-B. As a result, the current flowing to resistor Rh-A is smaller than the current flowing to resistor Rh-B. The ratio between the above two current flows when C=1 and the ratio between the above two current flows when C=0 are in symmetry.

When the amounts of current flows to resistors Rh-A and Rh-B differ from each other as described above, a bubble generation time difference arises between the two split thermal resistors 13. This makes it possible to deflect the ink discharge direction.

For a situation where C=1 and a situation where C=0, symmetrical positions in the nozzle array direction can be selected to specify the ink deflection direction.

The above description relates to a case where only deflection control switch J3 is turned ON/OFF. However, when deflection control switches J2 and J1 are turned ON/OFF in addition to deflection control switch J3, the amounts of current flows to resistors Rh-A and Rh-B can be adjusted in smaller increments.

More specifically, deflection control switch J3 can control the currents flowing to transistors M4 and M6. Deflection control switch J2 can control the currents flowing to transistors M9 and M11. Deflection control switch J1 can control the currents flowing to transistors M14 and M16.

As described earlier, drain currents can flow to transistors M4 and M6, transistors M9 and M11, and transistors M14 and M16 at a ratio of 4:2:1. The ink deflection direction can then be varied over eight steps with three bits of deflection control switches J1 through J3 ((J1, J2, J3)=(0, 0, 0), (0, 0, 1), (0, 1, 0), (0, 1, 1), (1, 0, 0), (1, 0, 1), (1, 1, 0), and (1, 1, 1)).

Further, when the voltage to be applied between the gates of transistors M2, M7, M12, and M17 and the ground is varied, the amount of current varies. Therefore, the deflection amount per step can be varied while the drain currents flowing to the transistors are maintained at a ratio of 4:2:1.

Furthermore, symmetrical positions in the nozzle array direction can be selected with the deflection direction selector switch C to specify the ink deflection direction.

For a line head, a zigzag layout may be employed so that a plurality of heads 11 are arrayed in the direction of the print paper width and that heads 11 adjacent to each other face each other (the angular position of one head is 180° away from that of a neighboring head). If, in the above situation, a common signal is transmitted from the deflection control switches J1 through J3 to two heads 11 that are adjacent to each other, the deflection direction of one head 11 is opposite the deflection direction of the other head 11. Therefore, the present embodiment incorporates the deflection direction selector switch C so that the entire deflection direction of a head 11 can be symmetrically changed.

Therefore, when the value C is set to 0 for heads placed in even-numbered positions (heads N, N+2, N+4, and so on) and set to 1 for heads placed in odd-numbered positions (heads N+1, N+3, N+5, and so on) in a situation where a line head is formed by positioning a plurality of heads 11 in a zigzag pattern, the same deflection direction is set for all heads 11 that constitute the line head.

Discharge angle correction switches S and K are similar to deflection control switches J1 through J3 in that they deflect the ink discharge direction. In reality, however, discharge angle correction switches S and K are used to correct the ink discharge angle.

Discharge angle correction switch K is used to determine whether the ink discharge angle should be corrected. It is set so that it corrects the ink discharge angle when K=1 and does not correct the ink discharge angle when K=0.

Discharge angle correction switch S is used to determine the correction direction with respect to the nozzle array direction.

If, for instance, K=0 (the ink discharge angle is not to be corrected), one of the three inputs of AND gates X8 and X9 is 0. Therefore, the outputs of AND gates X8 and X9 are both 0. Transistors M18 and M20 then turn OFF. Thus, transistors M19 and M21 also turn OFF. Consequently, the currents flowing to resistors Rh-A and Rh-B remain unchanged.

On the other hand, if, for instance, S=0 and C=0 in a situation where K=1, the output of XNOR gate X16 is 1. Then, (1, 1, 1) enters AND gate X8. Therefore, its output is 1. Thus, transistor M18 turns ON. Further, one input of AND gate X9 is set to 0 via NOT gate X17. Therefore, the output of AND gate X9 is 0 so that transistor M20 turns OFF. Since transistor M20 is OFF, no current flows to transistor M21.

Due to the CM circuit characteristics, no current flows to transistor M19 either. However, transistor M18 is ON. Therefore, a current flows out of a midpoint between resistors Rh-A and Rh-B. Thus, a current flows to transistor M18. Consequently, the amount of current flowing to resistor Rh-B can be rendered smaller than the amount of current flowing to resistor Rh-A. This makes it possible to correct the ink discharge angle and shift the ink landing position by a predefined amount in the nozzle array direction.

The embodiment described above makes corrections with two bits, which are provided by discharge angle correction switches S and K. However, if the number of switches increased, it is possible to make finer corrections.

When switches J1 through J3, S, and K are used to deflect the ink discharge direction, the current (deflection current Idef) can be expressed as follows:

$$Idef = J3\times4\times Is + J2\times Is + J1\times Is + S\times K\times Is \quad \text{(Equation 1)}$$

$$= (4\times J3 + 2\times J2 + J1 + S\times K)\times Is$$

In Equation 1, the value +1 or −1 is given to J1, J2, and J3. The value +1 or −1 is given to S. The value +1 or 0 is given to K.

As is obvious from Equation 1, the deflection current setting can be varied over eight steps by changing the J1, J2, and J3 settings. Further, corrections can be made by S and K independently of the J1, J2, and J3 settings.

The deflection current setting can be varied over four positive value steps and four negative value steps. Therefore, the ink deflection direction can be set as either the leftward direction or rightward direction with respect to the nozzle array direction. Referring to FIG. 3, the ink discharge direction can be deflected leftward by θ with respect to the vertical (direction Z1 in FIG. 3) or deflected rightward by θ with respect to the vertical (direction Z2 in FIG. 3). The value θ, that is, the deflection amount, can be set as desired.

The ink discharge angle adjustment to be made when the distance H is changed (when the distance between the ink discharge surface and ink landing surface is changed), that is, when the print paper thickness is changed will now be described.

The printer according to the present embodiment includes the distance detection means, which detects the distance between the ink discharge surface of a head 11 and the ink landing surface of print paper.

The distance detection means may directly detect the distance between the ink discharge surface and the ink landing surface of print paper or determine the distance by detecting the thickness of the print paper (paper thickness). In the present embodiment, the distance detection means uses a sensor to achieve distance detection.

An optical sensor, pressure sensor, or other sensor for reading the information about light, pressure, displacement, or other physical quantity may be used as the sensor for distance detection.

If, for instance, an optical sensor is used, it is provided with a light-emitting element and a light-receiving element, and configured so that the light-emitting element emits light to print paper and that the light-receiving element receives the light reflected from the print paper. The distance between the ink discharge surface and the ink landing surface of the print paper onto which the light falls is measured in accordance with the state of the received reflected light.

If a pressure sensor is used, it is pressed against the print paper surface (ink landing surface). The resulting pressure value is measured and compared against a predetermined reference value (pressure value for reference paper thickness). The paper thickness is calculated from the result of comparison. The distance between the ink discharge surface and the ink landing surface of the print paper is then calculated (detected) from the calculated paper thickness.

The printer also includes the discharge deflection amount determination means. The discharge deflection amount determination means determines the amount of liquid discharge deflection, which is to be provided by the discharge direction deflection means, in accordance with the result of detection achieved by the above distance detection means.

In the present embodiment, the discharge deflection amount determination means controls the voltage to be applied to the deflection amplitude control terminal B in accordance with the above detection result (for example, a D/A converter can be employed to provide digital control).

As described earlier, transistors M2, M7, and M12 are in a ratio of ×4:×2:×1. Therefore, their drain currents are in a ratio of 4:2:1. Thus, the amount of current can be varied over eight steps with the deflection amplitude control terminal B. Consequently, the deflection amount for ink discharge can be adjusted over eight steps. It goes without saying that the amount of current can be varied over an increased number of steps if the number of transistors is increased.

Figure 6A:
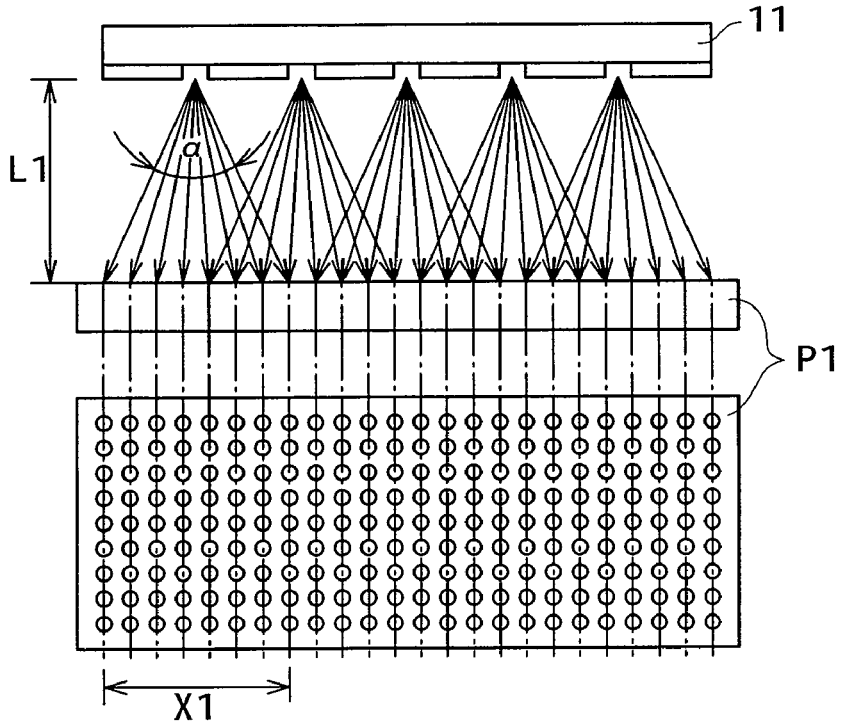
FIGS. 6A and 6B illustrate how discharge deflection amount determination means according to a first embodiment of the present invention determines a deflection amount.
Figure 6B:
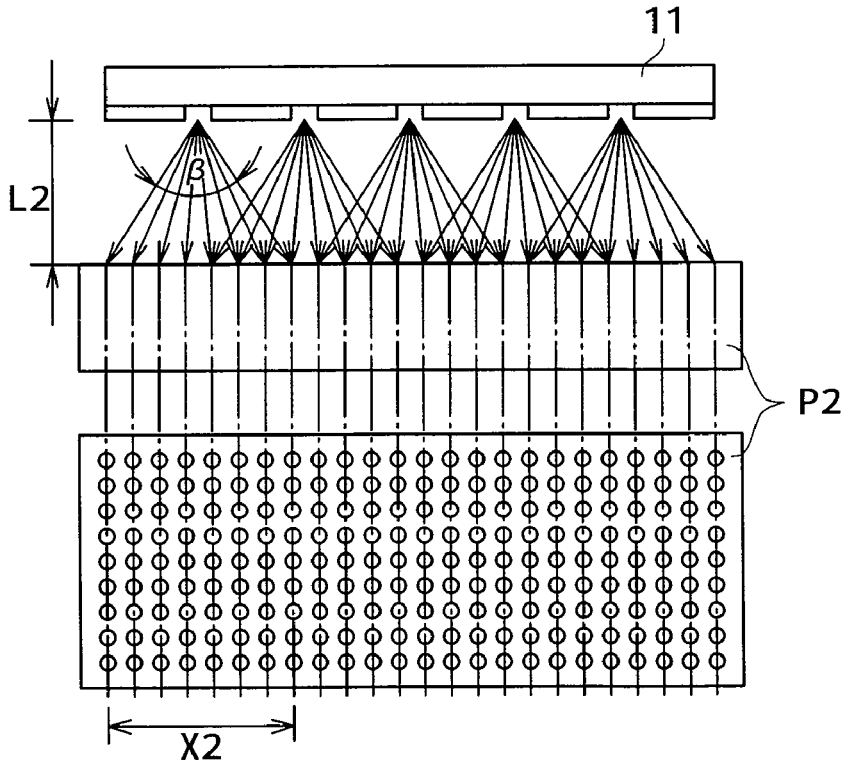

FIGS. 6A and 6B illustrate how the discharge deflection amount determination means determines the deflection amount. It is assumed, as indicated in FIG. 6A, that the discharge angle (maximum deflection amount) is set at a while the distance H between the ink discharge surface and the ink landing surface of print paper P1 is equal to reference value L1. As described earlier, discharge angle α can be varied over eight steps with the three bits of deflection control switches J1 through J3.

If, in the above situation, a print is to be made on print paper P2, which is thicker than print paper P1, the distance H between the ink discharge surface and print paper P2 is detected (H=L2). Discharge angle β is determined in accordance with the detection result so that the ink lands at the ink landing position for discharge angle α or at a position closest to the ink landing position.

When, in FIG. 6A, the distance H between the ink discharge surface and print paper P1 is equal to L1, ink landing position range (maximum value) X1, which is provided by discharge angle α, is as follows:

$$X1=2\times L1\times\tan(\alpha/2)$$

Therefore, even when the distance H between the ink discharge surface and print paper P2 is equal to L2 as indicated in FIG. 6B, ink landing position range (maximum value) X2, which is provided by discharge angle β, should be as follows:

$$X2(=2\times L2\times\tan(\beta/2))=2\times L1\times\tan(\alpha/2)$$

Consequently, the voltage at the deflection amplitude control terminal B should be controlled so that discharge angle β satisfies the above equation.

When control is exercised as described above, it is possible to determine the optimum discharge angle and deflect the ink discharge direction even when the thickness of print paper P varies, that is, even when prints are to be made on various sheets of print paper P, which differ in paper thickness.

The distance detection means does not always have to use the above sensor. For example, the following alternative methods may be employed.

A first alternative is to receive information about, for instance, the employed print paper (plain paper, coated paper, photographic paper, etc.), which is transmitted together with print data at the time of printing and used to determine the print paper properties, and detect the distance between the liquid discharge surface of a head 11 and the ink landing surface of print paper P in accordance with the received information. For example, reference paper thickness data concerning various types of print paper may be stored in memory so as to determine the employed paper thickness in accordance with the received information and stored reference paper thickness data and detect the distance in accordance with the determined paper thickness.

A second alternative is to receive information that is input into a computer or directly input into a printer and used to determine the print paper properties, and detect the distance between the ink discharge surface and the ink landing surface of print paper P in accordance with the received information. For example, the information about the type of print paper may be received when it is input with an operation means such as a keyboard of a computer or otherwise entered so as to determine the employed paper thickness in the same manner as described above and detect the above distance in accordance with the determined paper thickness.

Second Embodiment

A second embodiment of the present invention will now be described.

Even when the print paper thickness varies, that is, prints are to be made on various sheets of print paper having different paper thicknesses, the first embodiment can determine the optimum ink discharge angle and deflect the ink discharge direction.

However, if the paper thickness varies from one ink landing area to another of a single sheet of print paper, the first embodiment does not properly work. On the other hand, the second embodiment constantly detects the paper thickness. If the paper thickness changes in the middle of a printing process, the second embodiment determines the optimum ink discharge angle again.

Figure 7:
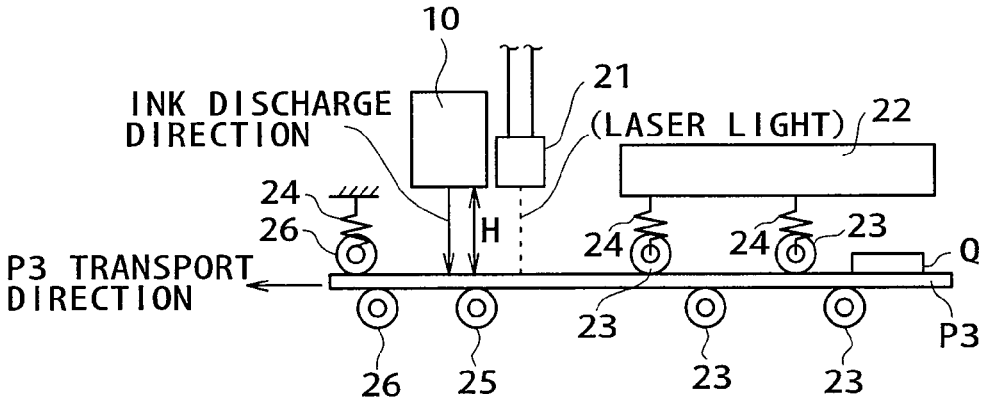
FIG. 7 is a side view that schematically shows the configuration of a printer according to a second embodiment of the present invention.
Figure 8:
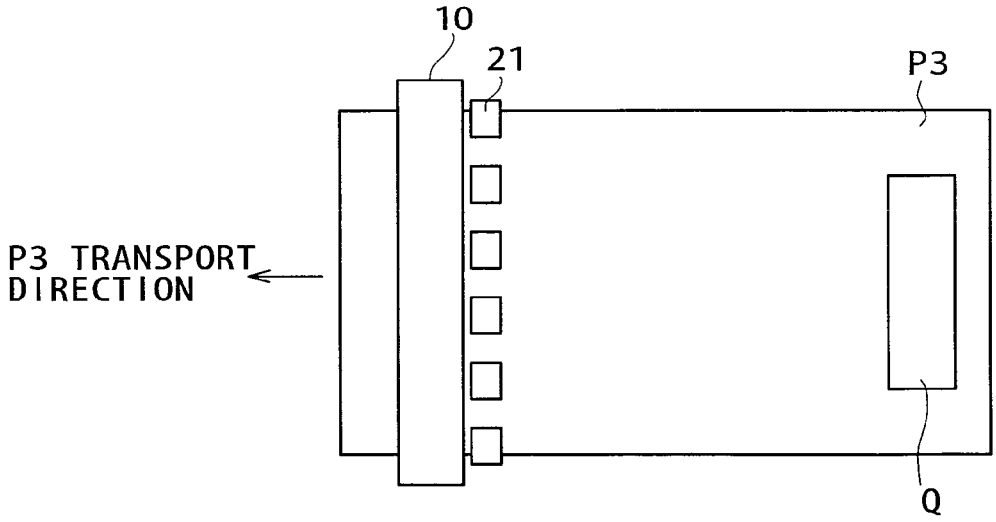
FIG. 8 is a plan view of the printer shown in FIG. 7. This plan view excludes a print paper transport drive system.
Figure 9:
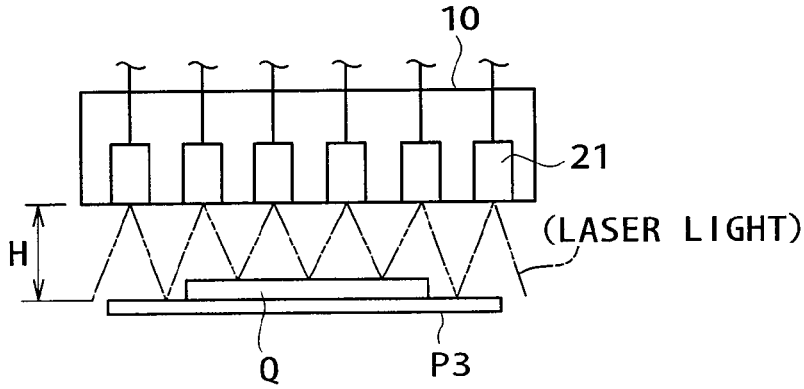
FIG. 9 is a front view the printer shown in FIG. 8. This figure is obtained when the printer is viewed from a section from which print paper is loaded into a line head section.

FIG. 7 is a side view that schematically shows the configuration of a printer according to the second embodiment. FIG. 8 is a plan view of the printer shown in FIG. 7. This plan view excludes a transport drive system for print paper P3. FIG. 9 is a front view the printer shown in FIG. 8. This figure is obtained when the printer is viewed from a section from which the print paper P3 is transported to a line head 10.

As indicated in FIGS. 7 through 9, the surface height or thickness of the print paper P3 for use with the second embodiment varies. More specifically, an ink landing surface area is partly provided with a projection Q.

The line head 10 of the printer is obtained by linearly arranging the aforementioned heads 11 in the direction of the print paper width.

The printer uses the relative movement means to provide relative movement of the line head 10 and print paper P3. More specifically, the line head 10 is fixed so that the print paper P3 moves relative to the line head 10. The transport drive system for the print paper P3, which corresponds to the relative movement means, is configured as indicated in FIG. 7. The configuration will now be described.

Four paper feed rollers 23 are positioned upstream of the line head (positioned in a section from which the print paper P3 is transported to the line head 10). The two paper feed rollers 23 below the print paper P3 are driven and rotated by a motor or other drive means (not shown). The remaining two paper feed rollers 23 are positioned above the print paper P3 (positioned toward the ink landing surface). A retention member 22 is installed over the print paper P3. Two springs 24 are mounted on the underside of the retention member 22. The paper feed rollers 23 are mounted on the lower ends of the springs 24 in such a manner that the paper feed rollers 23 freely rotate.

As such being the case, the paper feed rollers 23 positioned above the print paper P3 can move up and down due to the springs 24. Therefore, even when the projection Q on the print paper P3 passes through the paper feed rollers 23, the springs 24 are merely compressed. Consequently, a substantially constant pressure is continuously applied so that the paper feed rollers 23 positioned above the print paper P3 is pressed against the print paper P3.

The print paper P3 is sandwiched among the above four paper feed rollers 23 and transported toward the line head 10.

A support roller 25 is placed substantially directly below the line head 10 and near the ink landing position. The support roller 25 supports the print paper P3 from below so as to avoid a change in the distance (gap) between the ink discharge surface of the line head 10 and the surface of the print paper P3 during printing.

A pair of paper discharge rollers 26 are positioned downstream of the line head 10. The print paper P3 is sandwiched between the paper discharge rollers 26 and transported. The paper discharge roller 26 positioned below the print paper P3 is mounted in the same manner as for the paper feed rollers 23 positioned below the print paper P3, and driven and rotated by a motor or other drive means (not shown). The paper discharge roller 26 positioned above the print paper P3 is mounted on a leading end of a spring 24, which is attached to a predetermined member, in the same manner as for the paper feed rollers 23 positioned above the print paper P3. More specifically, the paper discharge roller 26 positioned above the print paper P3 is mounted in such a manner that the paper discharge roller 26 freely rotates.

When the paper feed rollers 23 and paper discharge roller 26 rotate counterclockwise within the configuration described above, the print paper P3 is transported in the direction of an arrow as indicated in FIG. 7 or 8, and the nozzles 18 of the liquid discharge sections of the heads 11 included in the line head 10 discharge ink. The discharged ink then lands on the print paper P3.

Sensors 21, which correspond to the distance detection means according to the present invention, are positioned over a print paper transport path and between the line head 10 and paper feed rollers 23.

In the present embodiment, a plurality of sensors 21 are provided (six sensors are provided in the example shown in FIGS. 8 and 9), and arrayed in the direction of the length of the line head 10 (in the direction of liquid discharge section arrangement). The detection surfaces of the sensors 21 are in alignment of the ink discharge surface of the line head 10 as indicated in FIG.

The sensors 21 emit laser light (pulsed light) to the ink landing surface of the print paper P3, receives the light reflected from the ink landing surface, and detects the distance H between the ink discharge surface of the line head 10 and the ink landing surface of the print paper P3, which is shown in FIG. 7, in accordance with the wavelength of the received reflected light.

As shown in FIG. 9, the sensors 21 according to the present embodiment have their own predefined detection regions, which are arrayed in the direction of liquid discharge section arrangement. Therefore, the plurality of sensors 21 provided for the line head 10 are able to measure the distance H directly below every liquid discharge section of the line head 10.

More specifically, the sensors 21 according to the present embodiment are capable of performing a rapid scan over a maximum width of 40 mm in the direction of liquid discharge section arrangement. The sensors 21 complete one cycle of operation in 30 msec and gather 1000 points of data from a width of 40 mm. When six sensors 21 are installed as shown in FIGS. 8 and 9, therefore, they gather 6000 points of data from a width of 240 mm.

If, for instance, one line head 10 has 5120 liquid discharge sections, the six sensors 21 can measure the distance H substantially directly below all the 5120 liquid discharge sections.

Figure 10:
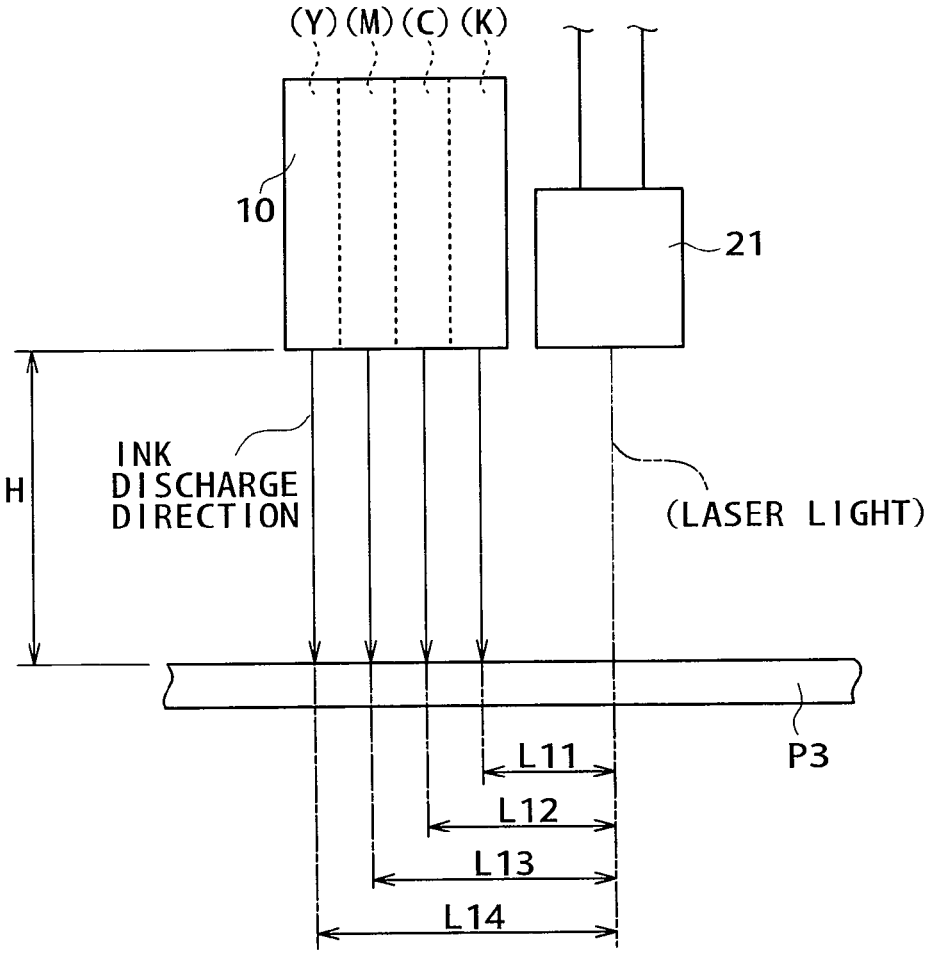
FIG. 10 is a side view illustrating in detail the positional relationship between a line head and sensors.

FIG. 10 is a side view illustrating in detail the positional relationship between the line head 10 and sensors 21. The line head 10 according to the present embodiment is a color line head, which is obtained by arranging the above-mentioned heads 11 in the direction of liquid discharge section arrangement to form a color line head (four colors (Y, M, C, and K) in the example shown in FIG. 10).

In the above situation, the distances (L11 to L14 in FIG. 10) in the print paper transport direction between the detection points of the sensors 21 and the ink landing positions of various color line heads differ from each other. Therefore, these distances L11 to L14 are stored in memory beforehand so that the ink discharge distance H from the liquid discharge sections of various color line heads can be determined in accordance with the stored distances L11 to L14 and print paper transport speed.

Figure 11:
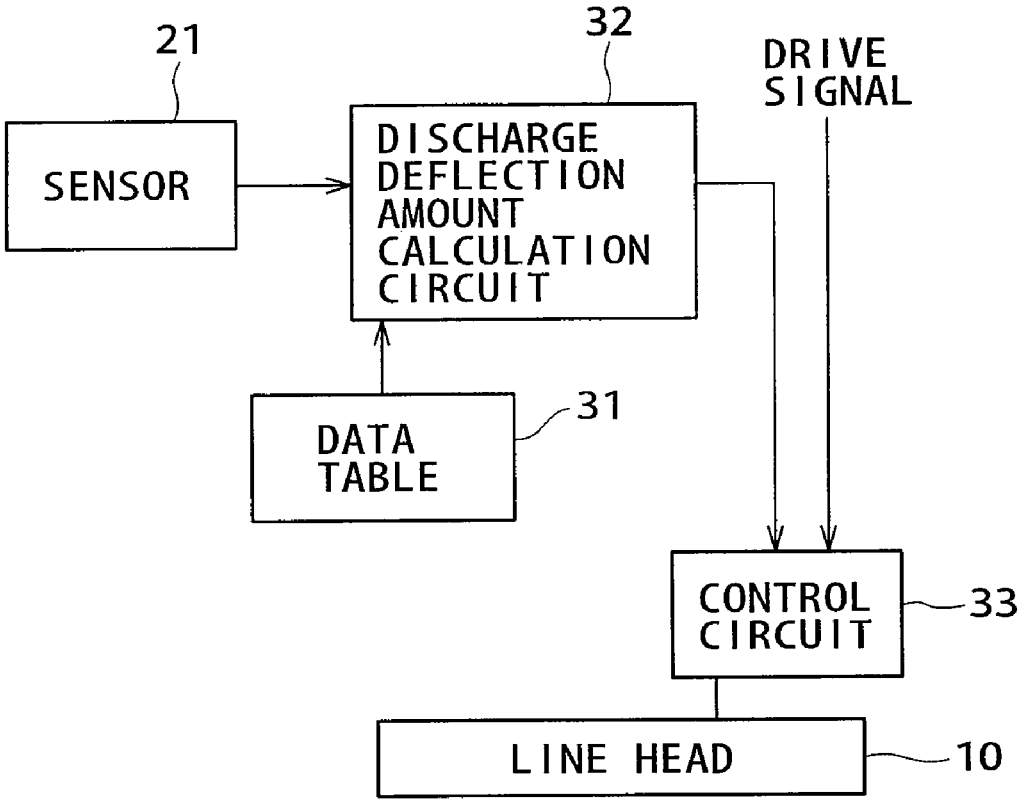
FIG. 11 is a block diagram illustrating a sensor (distance detection means), a data table, and a discharge deflection amount calculation circuit, which serves as discharge deflection amount determination means, in accordance with the second embodiment of the present invention.

FIG. 11 is a block diagram illustrating a sensor 21 (distance detection means), a data table 31, and a discharge deflection amount calculation circuit 32, which serves as the discharge deflection amount determination means, in accordance with the present embodiment.

When the sensors 21 detect the distance H for each liquid discharge section as described earlier, the result of detection is sent to the discharge deflection amount calculation circuit 32. In accordance with the detection result produced by the sensors 21, the discharge deflection amount calculation circuit 32 references the data table 31 and determines the discharge deflection amount for each liquid discharge section.

The data table 31 defines the discharge deflection amount for the ink to be discharged from a liquid discharge section, which varies with the detected distance H and the landing target position of the ink to be discharged from the liquid discharge section.

Figure 12:
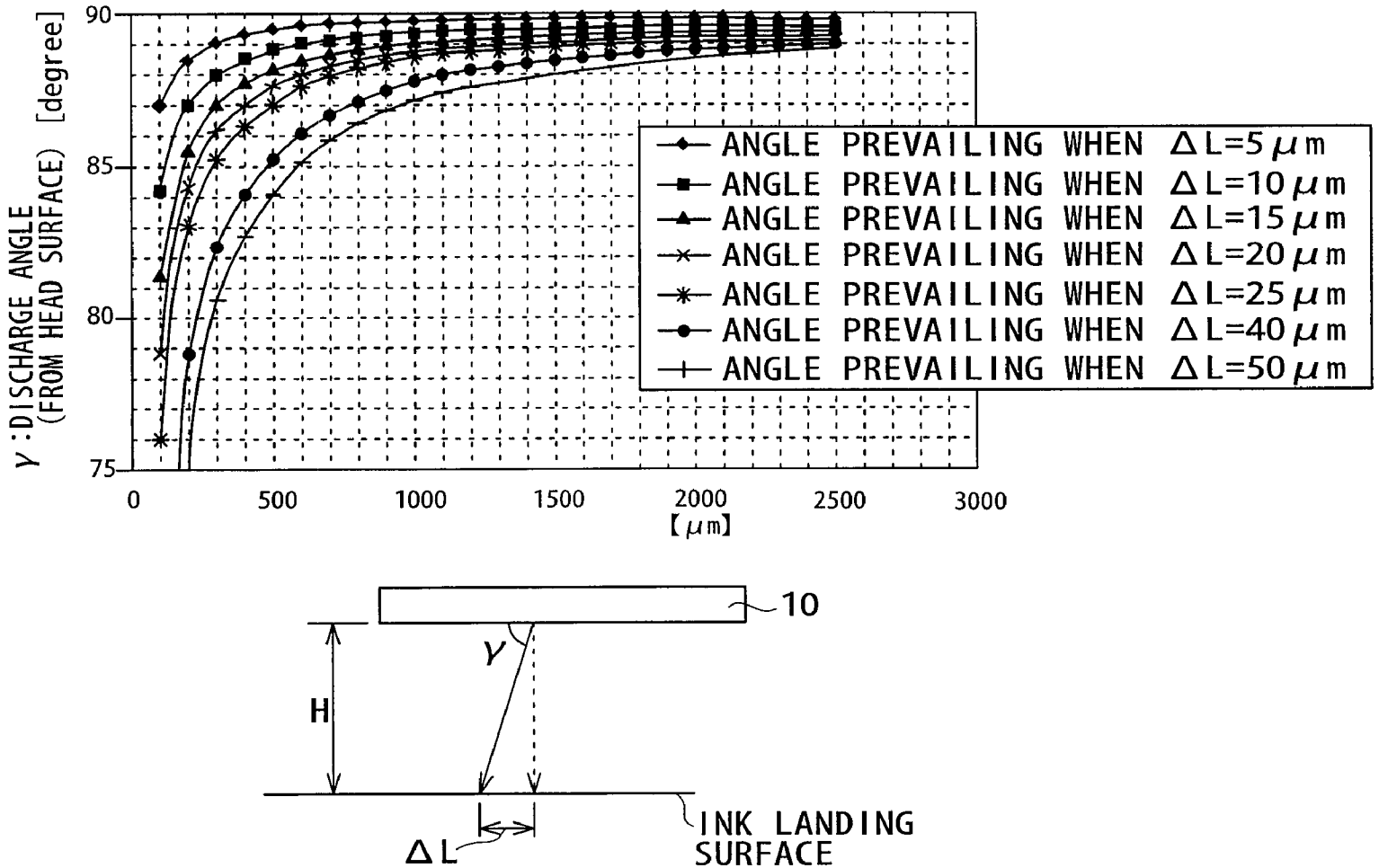
FIG. 12 illustrates the data table.

FIG. 12 illustrates the data table 31.

As is the case with FIG. 3, FIG. 12 assumes that the distance between the ink discharge surface of the line head 10 and the ink landing surface (the upper surface of the print paper P3) is H, and that the deflection amount $\Delta L$ is the distance between the ink landing position (indicated by an arrow with a broken line in FIG. 12) prevailing when the ink is discharged directly below from a liquid discharge section of the line head 10 (when the ink is discharged vertically to the ink landing surface) and the ink landing position (indicated by an arrow with a solid line in FIG. 12) prevailing when the discharged ink is deflected.

FIG. 12 also assumes that the discharge angle $\gamma$ is the angle between the ink discharge surface and the direction in which the discharged ink is deflected. The example shown in FIG. 12 assumes that the discharge angle $\gamma$ is as described above. However, as indicated in FIG. 3, the angle ($\theta$ in FIG. 3) between the vertical and the ink landing surface may be referred to as the discharge angle ($\gamma=90°-\theta$ in the example shown in FIG. 12).

When, in the above instance, the distance H and deflection amount $\Delta$ are given as described above, the discharge angle $\gamma$ can be determined as a function of the distance H and deflection amount $\Delta L$.

The data table 31 stores beforehand the relationship among the distance H, deflection amount $\Delta L$, and discharge angle $\gamma$.

Therefore, when the distance H is transmitted as a result of detection by the sensors 21, the discharge deflection amount calculation circuit 32 references the data table 31 and calculates the discharge angle in accordance with the data table 31. Then, the discharge deflection amount calculation circuit 32 transmits the resulting discharge angle data to a control circuit 33 as serial data.

In accordance with the transmitted discharge angle data and the drive signal for ink discharge, the control circuit 33 controls the line head 10, that is, controls the ink discharge from each liquid discharge section.

The control circuit 33 also determines the voltage to be applied to the deflection amplitude control terminal B of the circuit shown in FIG. 5 in order to obtain a discharge angle in accordance with the discharge angle data transmitted from the discharge deflection amount calculation circuit 32.

The above control is always exercised when the ink is continuously discharged. In other words, while the print paper P3 is transported, the sensors 21 constantly detect the distance H and sequentially transmit the results of detection to the discharge deflection amount calculation circuit 32. Further, the discharge deflection amount calculation circuit 32 constantly performs calculations for each pixel line to determine what liquid discharge section should discharge ink at what discharge angle $\gamma$, and transmits the calculation results to the control circuit 33 in real time. In this instance, the distances (L11 to L14) between the detection points of the sensors 21 and the ink discharge positions of various color line heads are considered as indicated in FIG. 10 to perform setup so that the pixel lines properly correspond to the detection results produced by the sensors 21 and the discharge angle $\gamma$ obtained as a result of detection result calculations.

Figure 13:
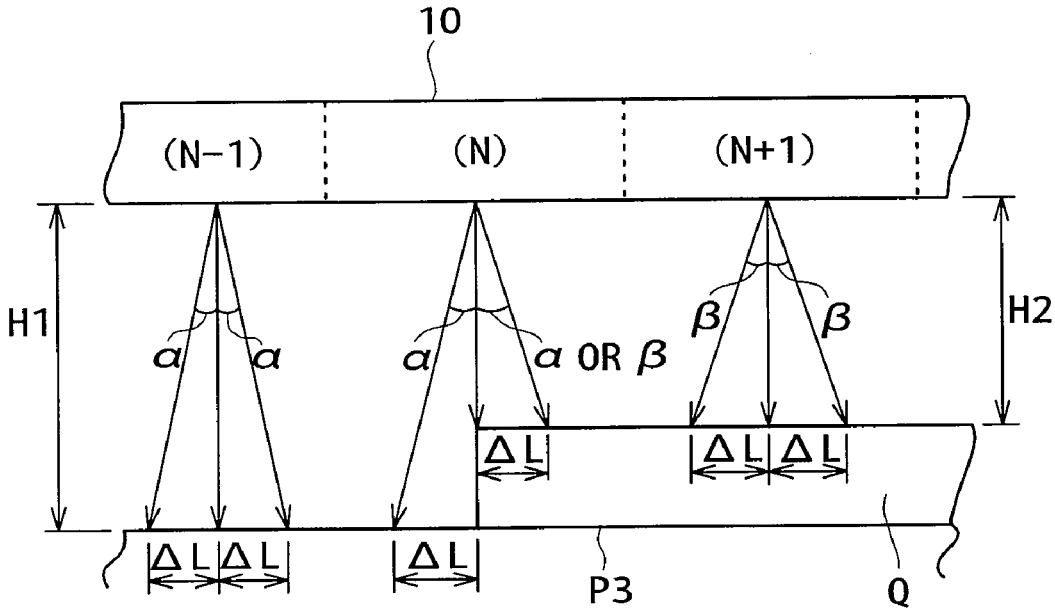
FIG. 13 is a front view of the line head. This figure indicates how ink is discharged by three liquid discharge sections named "N−1", "N", and "N+1".

Ink discharge control that is exercised by the control circuit 33 will now be described. FIG. 13 is a front view of the liquid discharge sections of the line head 10. This figure indicates how ink is discharged by three liquid discharge sections named "N−1", "N", and "N+1".

In the example shown in FIG. 13, the ink landing position provided by liquid discharge section "N−1" is away from the projection Q. The ink landing position provided by liquid discharge section "N" is at a boundary of the projection Q. The ink landing position provided by liquid discharge section "N+1" is on the projection Q.

The example shown in FIG. 13 assumes that each liquid discharge section not only discharges ink vertically to the print paper P3 but also discharges ink so that the ink lands at positions that are shifted in the liquid discharge section array direction from the vertical landing position by the deflection amount ΔL.

If, in the above instance, the distance H between the discharge surface of liquid discharge section "N−1" and the ink landing surface of the print paper P3 is H1, the sensors 21 detect distance H1. Therefore, the discharge deflection amount calculation circuit 32 uses the following equation to calculate discharge angle α for shifting the discharged ink by the deflection amount ΔL from the vertical position:

$$\alpha=\tan^{-1}(\Delta L/H1)$$

The control circuit 33 then determines the voltage to be applied to the deflection amplitude control terminal B in such a manner as to provide discharge angle α as indicated above, and controls the ink discharge from liquid discharge section "N−1".

As regards liquid discharge section "N", discharge angle α for shifting the discharged ink leftward from the vertical position by the deflection amount ΔL is calculated in the same manner as indicated above.

On the other hand, discharge angle β for shifting the discharged ink rightward from the vertical position by the deflection amount ΔL is calculated as follows:

$$\beta=\tan^{-1}(\Delta L/H2)$$

The control circuit 33 then determines the voltage to be applied to the deflection amplitude control terminal B in such a manner as to provide discharge angle β as indicated above, and controls the ink discharge from liquid discharge section "N".

In a situation where the ink partly lands on the projection Q depending on the ink discharge direction as is the case with liquid discharge section "N", the same discharge angle may be used (α or β). This makes it possible to simplify the employed control scheme. If, for instance, the discharge angle is set to α in a situation where liquid discharge section "N" discharges ink and deflects it rightward, the resulting displacement will not be rendered conspicuous by one dot or so. Therefore, the control scheme may be simplified as described above.

As regards liquid discharge section "N+1", the ink lands on the projection Q. Therefore, the discharge angle is changed from α. to β so that the deflection amount is ΔL.

Figure 14:
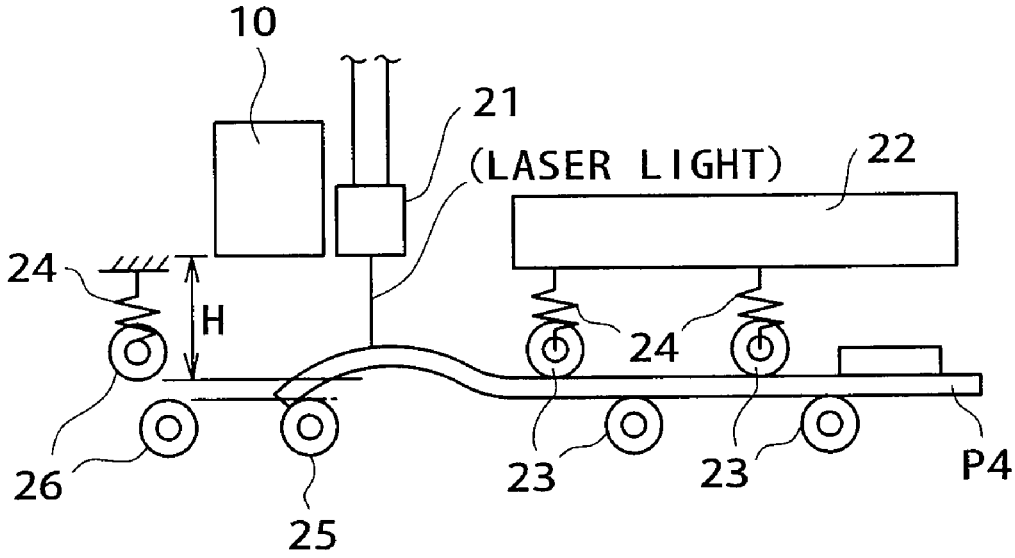
FIG. 14 is a side view illustrating an example in which distance varies even when the employed print paper does not have any projection.

FIG. 14 is a side view illustrating an example in which the distance H varies even when the print paper does not have any projection. This figure corresponds to FIG. 7.

As indicated in FIG. 14, print paper P4 is transported toward the line head 10 while its leading end is curled.

Within the printer, the discharged ink passes through a space between the underside of the line head 10 and the upper surface (ink landing surface) of print paper P4. Therefore, rollers, retainers, and other members for pressing the upper surface of print paper P4 cannot be installed in the space. Therefore, only the support roller 25 (or other support member or the like) is generally installed to support print paper P4 from below under the line head 10.

The paper feed rollers 23 are installed on the print paper loading side of the line head 10. These paper feed rollers 23 not only transport print paper P4 to the line head 10 but also come into contact with the ink landing surface (the upper surface in the figure) of print paper P4 to keep the distance H constant.

In the above instance, the sensors 21 are installed so that emitted laser light and its reflection pass between the line head 10 and the paper feed rollers 23 and other retention members, which are arranged in the print paper transport direction (leftward or rightward in the figure).

Therefore, if the leading end is curled as is the case with print paper P4, the distance H varies with the curl.

However, the present embodiment uses the sensors 21, which are positioned just before print paper P4 under the line head 10, for detecting the distance H. Therefore, even when print paper P4 is curled, the present embodiment can detect the distance H, which varies with the curl, as accurately as possible.

Third Embodiment

Figure 15:
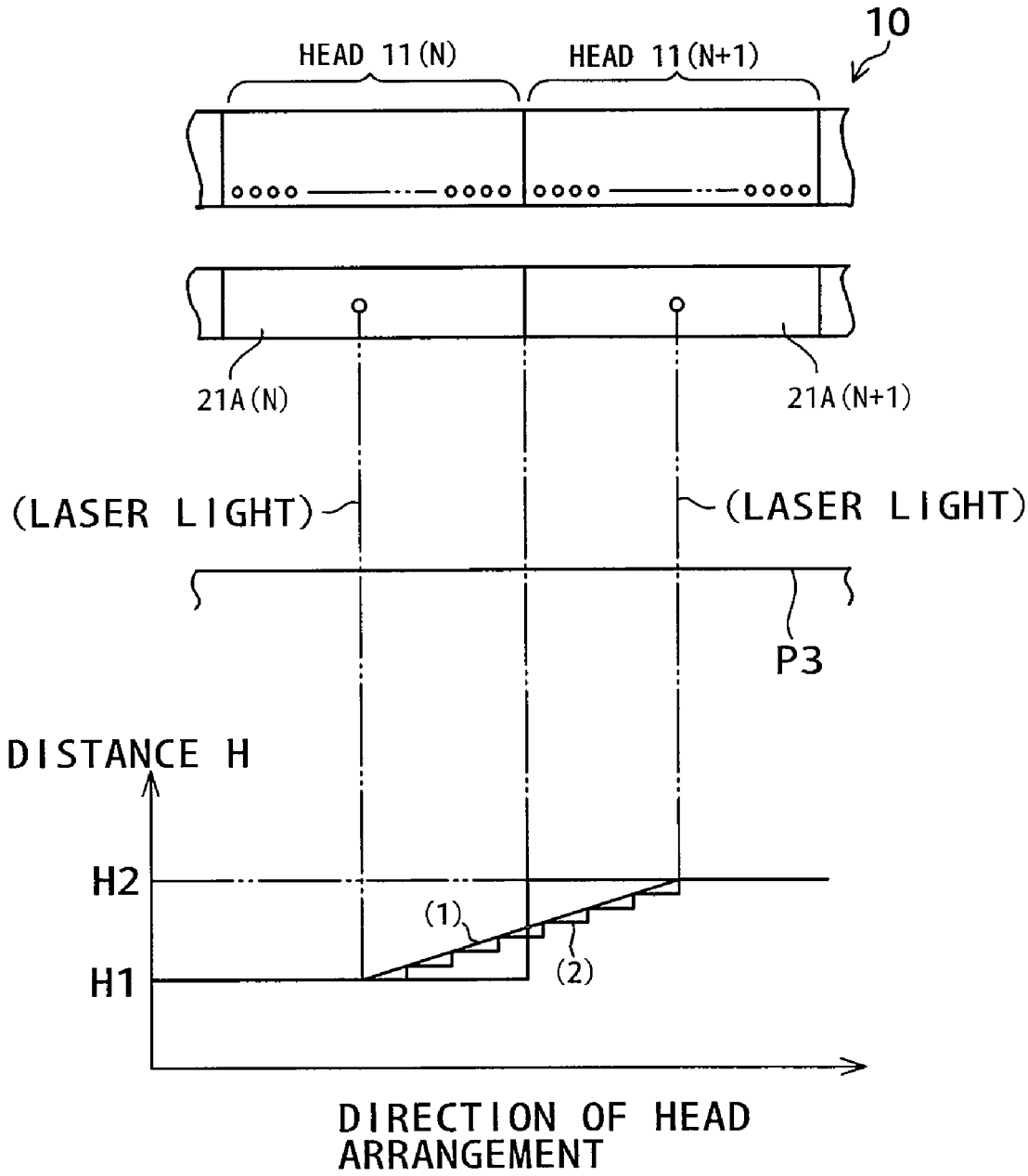
FIG. 15 illustrates a third embodiment of the present invention.

FIG. 15 illustrates a third embodiment of the present invention. The third embodiment is a modified version of the second embodiment. The third embodiment operates so that ink lands on print paper P3, which has the projection Q, but uses sensors that differ from those used in the second embodiment.

As shown in FIG. 15, the sensors 21A according to the third embodiment emit pinpoint laser light.

As indicated in FIG. 15, each head 11 in the line head 10 is provided with one sensor 21A. This ensures that one head 11 detects the distance H of only one location.

Therefore, there is a distance H nondetection area between the sensors 21A.

As indicated in FIG. 15, it is assumed that the Nth sensor 21A (N), which corresponds to the Nth head 11, detects the distance H between the discharge surface of the Nth head 11 and the ink landing surface of print paper P3 as H1.

As indicated in FIG. 15, it is also assumed that the N+1th sensor 21A (N+1), which corresponds to the N+1th head 11, detects the distance H between the discharge surface of the N+1th head 11 and the ink landing surface of print paper P3 as H2.

In the above instance, the distance can be determined at a position at which laser light is emitted. However, the distance H at a position between laser light emission positions is unknown.

When it is assumed, as indicated in FIG. 15, that the distance H for the Nth head 11 is H1, and that the distance H for the N+1th head 11 is H2, the discharge angle suddenly changes at a position at which the distance H changes from H1 to H2, that is, at a boundary between the rightmost liquid discharge section of the Nth head 11 and the leftmost liquid discharge section of the N+1 th head 11. It means that a considerable discharge angle change occurs. Such a discharge angle change may be obvious as ink landing position displacement. This does not constitute a problem if the print paper surface height suddenly changes as mentioned above. However, a problem occurs if, for instance, the surface height gradually varies.

To solve the above problem, the third embodiment is provided with distance setup means.

If there is a distance H nondetection area between, for instance, the Nth and N+1th sensors 21A, a liquid discharge section corresponding to the nondetection area exists, and different distances H are detected by the sensors 21A (N) and 21A (N+1) (Nth and N+1th sensors) adjacent to the nondetection area, then the distance setup means sets the distance H concerning the liquid discharge section corresponding to the nondetection area to a value between the distance H1 detected by the Nth sensor 21A (N) and the distance H2 detected by the N+1th sensor 21A (N+1) (H2<H<H1).

Particularly in the example shown in FIG. 15, a straight line is drawn to join the detection position of the Nth sensor 21A (N) to the detection position of the N+1th sensor 21A (N+1) as indicated by (1), and then the distance H for each liquid discharge section is calculated in such a manner that the distance H gradually varies from one liquid discharge section to another. An alternative is to divide a distance H change into a plurality of steps, set fixed distances H for several liquid discharge sections, and calculate the distance H so that the distance H gradually varies from one of the several liquid discharge sections to another, as indicated by (2).

The discharge deflection amount calculation circuit 32 according, for instance, to the second embodiment may incorporate the functionality of the distance setup means.

The above scheme may also be applicable to a case where the sensors 21 according to the second embodiment are installed. In the second embodiment, the six sensors 21 can detect the distances H that relate to all the liquid discharge sections. However, if, for instance, less than six sensors 21 are installed, a nondetection area arises between the sensors 21. In such an instance, the distance setup means should be provided as described above to set the distance H for each liquid discharge section so that the distance H does not suddenly change in the direction of liquid discharge section arrangement.

Applications of Second and Third Embodiments

When sensors 21 or 21A are accurately installed relative to the line head 10, the distance H can be accurately detected.

However, if sensors 21 or 21A are not accurately installed in relation to the line head 10, the distance H detected by sensors 21 or 21A is in error. It is therefore preferred that the ink discharge surfaces of the liquid discharge sections in the line head 10 be in alignment with the detection surfaces of sensors 21 or 21A.

For example, an inspection is conducted to check that the ink discharge surfaces of the liquid discharge sections in the line head 10 are properly positioned in the direction of liquid discharge section arrangement (positioned horizontally to the ink landing surface). After the inspection has been conducted to verify that there is no positional displacement, the sensors 21 or 21A detect the reference distance between the ink discharge surface and ink landing reference surface at a plurality of positions in the liquid discharge section arrangement direction of the line head 10. In this instance, while no print paper exists, the above reference distance is detected, for instance, by handling the upper end surface of the support roller 25 as the ink landing reference surface.

If the results of detection indicate that the above reference distance varies from one of the plurality of positions to another, the correction values for the liquid discharge sections are calculated (correction value calculation means) in accordance with the detected reference distance, and then the results of calculations are stored beforehand (correction value storage means).

Then, the discharge deflection amount calculation circuit 32 should reference the data table 31, note the distances detected by sensors 21 or 21A, the liquid landing target positions, and the correction values stored by the correction value storage means, and determine the liquid discharge deflection amount for each liquid discharge section, which is provided by the discharge direction deflection means.

When the detection surfaces of sensors 21 or 21A are accurately positioned in relation to the ink discharge surface of the line head 10, the ink can be accurately landed without making the above correction even if the line head 10 is curved or the print paper support surface (support roller 25 in FIG. 7) directly below the ink discharge surface is curved.

In the above instance, the distances H detected by the liquid discharge sections differ from each other. Therefore, the ink discharge angle is individually determined in accordance with the distance H for each liquid discharge section. Thus, the same result is obtained as in a case where the projection Q exists on the ink landing surface of print paper P3.

Fourth Embodiment

Figure 16:
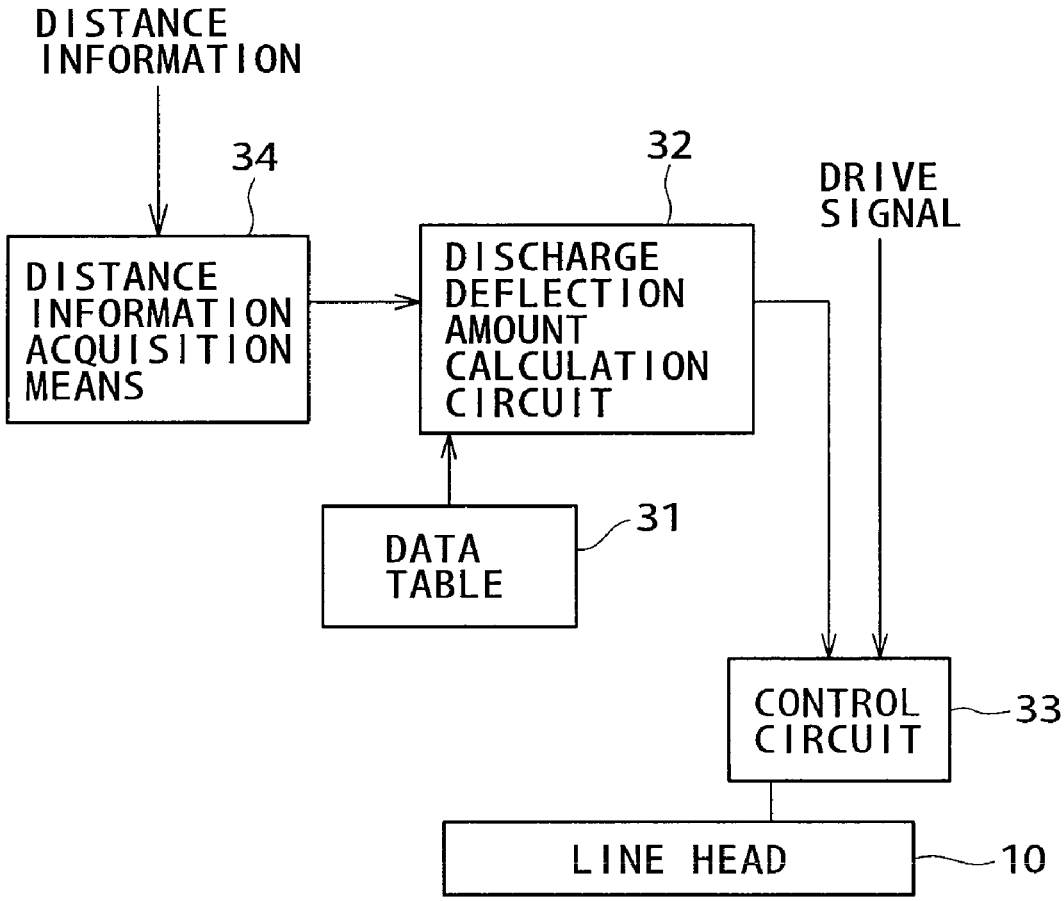
FIG. 16 is a block diagram illustrating a fourth embodiment of the present invention.
Figure 17A:
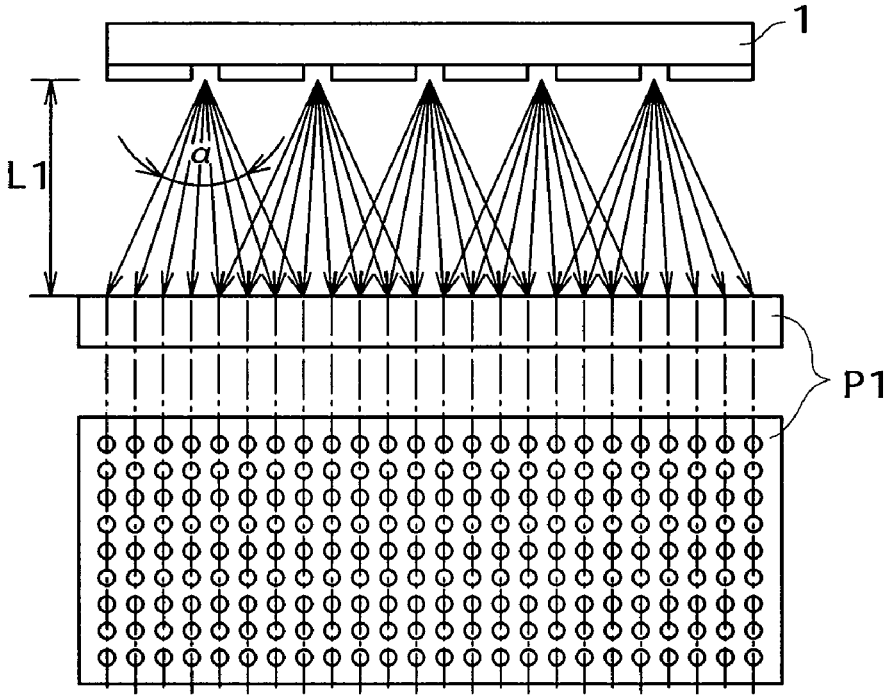
FIGS. 17A and 17B illustrate how a conventional technology makes prints on print papers P1 and P2, which differ in paper thickness, when the ink discharge angle is deflected by $\alpha$.
Figure 17B:
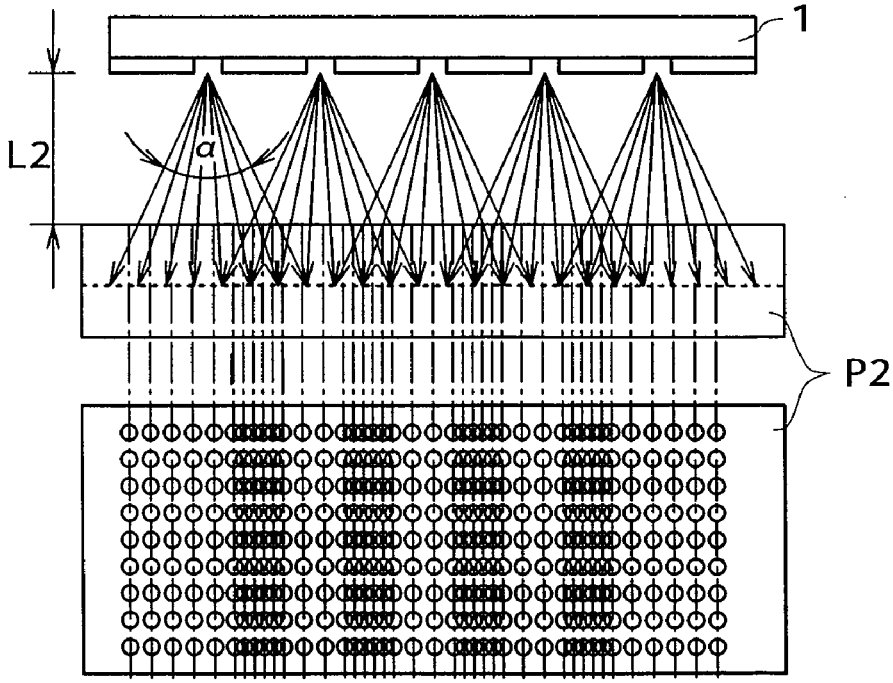

FIG. 16 is a block diagram illustrating a fourth embodiment of the present invention. This figure corresponds to FIG. 11, which illustrates the second embodiment.

The fourth embodiment is not provided with distance detection means such as sensors 21. Instead, the fourth embodiment includes the distance information acquisition means 34.

The distance information acquisition means 34 acquires distance information about the distance between the ink discharge surface of the line head 10 and the ink landing surface (the information about the distance H, that is, the information capable of identifying the distance H) in accordance with print paper transport.

The distance information is transmitted, for instance, from an external host computer or paper thickness designation means incorporated in the printer.

The distance information acquisition means 34 transmits the acquired distance information to the discharge deflection amount calculation circuit 32 as is the case with the second embodiment. The process performed by the discharge deflection amount calculation circuit 32 is the same as in the second embodiment.

As described above, the fourth embodiment does not actually detect the distance H with sensors 21 or the like, but sets the distance H in compliance with instructions received from the printer or from a device external to the printer.

The present embodiment is applicable, for instance, to a case where a resist is to be applied to a printed circuit board.

If a pattern existing on the printed circuit board is known, the distances H at various locations of the printed circuit board can be determined without having to actually measure the distances H.

If, when the distances H are known beforehand as mentioned above, the obtained distance information is converted to data and the distance information acquisition means 34 is allowed to acquire the resulting distance data and send it to the discharge deflection amount calculation circuit 32, the same advantage is obtained as in a case where the sensors 21 sequentially detect the distances in accordance with print paper transport.

The present invention has been described in terms of its preferred embodiments. However, the present invention is not limited to the above preferred embodiments, but extends to various modifications that are described below.

(1) In the foregoing embodiments, two split thermal resistors 13 are provided. However, three or more split thermal resistors 13 may alternatively be provided. Another alternative is to form a thermal resistor from a single nonsplit base substance, connect a conductor (electrode) to a turning point, for instance, of a substantially winding (e.g., substantially U-shaped) surface of the thermal resistor, divide a main thermal energy generation section for ink discharge into at least two sections via the turning point of the substantially winding surface, cause at least one main section and at least another main section to generate different levels of thermal energy, and exercise control to deflect the ink discharge direction in accordance with such a difference.

(2) In the examples used for the second and third embodiments, laser light is used to detect the distance H. However, various other material waves (electromagnetic wave, light wave, ultrasonic wave, etc.) can alternatively be used to detect the distance H. In the second and third embodiments in which laser light or other pulsed light is used, the distance H can be detected in accordance with the wavelength difference between the emitted light and reflected light. If an ultrasonic wave is used, the distance H can be detected by measuring the time interval between the instant at which the ultrasonic wave is emitted and the instant at which a reflected ultrasonic wave is received.

(3) In the second embodiment, the ink discharge surfaces of the liquid discharge sections in the line head 10 are flush with the laser light emission surfaces of sensors 21. Alternatively, however, an offset may be provided between the ink discharge surfaces of the line head 10 and the laser light emission surfaces of sensors 21. In such an instance, the provided offset amount should be stored in memory to calculate the distance H from the results of detection by sensors 21 and the stored offset amount. This also holds true for the third embodiment.

(4) In the second embodiment, the area for detecting the distance H is obtained for substantially the entire range in the liquid discharge section arrangement direction of the line head 10. However, if, in most cases, prints are to be made onto print paper having no significant irregularities, the number of sensors 21 may alternatively be reduced so that the area for detecting the distance H is not always obtained for substantially the entire range.

INDUSTRIAL APPLICABILITY

When the liquid discharge direction is to be deflected, the present invention makes it possible to set an appropriate deflection amount even if the distance between the liquid discharge surface and the liquid landing surface of a liquid discharge target varies. Therefore, the present invention ensures that the liquid lands at proper positions even when liquid discharge targets having various thicknesses are used.

In addition, the present invention can set a proper deflection amount accordingly even when the surface height of a single liquid discharge target varies.

We claim:

1. A liquid discharge method comprising the steps of:

using a liquid discharge apparatus including (1) a head, (2) a substrate within the head, (3) a plurality of nozzles arrayed on the head, (4) a liquid discharge section associated with each nozzle, (5) a liquid chamber associated with each liquid discharge section, (6) at least two heat generation units associated with each liquid chamber on the substrate, (7) means for relatively moving said head and a liquid discharge target (8) a discharge deflection amount calculation circuit and (9) a means for detecting a distance between the surface of the liquid discharge section and the surface of a liquid discharge target while the relative moving means moves said head and said liquid discharge target;

predetermining the discharge deflection amount for the liquid discharged from said nozzle in relation to (1) the distance between the surface of said liquid discharge section and the surface of a liquid discharge target and (2) a landing target position of the liquid discharged from said nozzle;

constantly detecting the distance between the surface of the liquid discharge section and the surface of a liquid discharge target while the relative moving means moves said head and said liquid discharge target and sequentially transmitting the distance to the discharge deflection amount calculation circuit via the distance detecting means;

determining the actual discharge deflection amount via the discharge deflection amount calculation circuit for the liquid corresponding to the liquid discharge section from (1) said detected distance, (2) the liquid landing target position, and (3) the predetermined discharge deflection amount; and generating a heat timing differential between the heat generation units, wherein, the distance detecting means (1) emits a material wave to the liquid discharge target from the distance detecting means (2) receives the resulting reflected wave at the distance detecting means and (3) detects the distance between the surface of the liquid discharge section and the surface of the liquid discharge target in accordance with the received reflected wave, and the heat timing differential determines the amount of heat required of each heat generating unit to deflect the direction of a liquid discharged from the nozzle.

* * * * *